US008741531B2

(12) United States Patent
Norikane et al.

(10) Patent No.: US 8,741,531 B2
(45) **Date of Patent: *Jun. 3, 2014**

(54) METHOD OF MANUFACTURING TONER, APPARATUS FOR MANUFACTURING TONER, AND METHOD OF MANUFACTURING RESIN PARTICLE

(75) Inventors: Yoshihiro Norikane, Kanagawa (JP); Masaru Ohgaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 65 days.

This patent is subject to a terminal disclaimer.

(21) Appl. No.: 13/445,236

(22) Filed: Apr. 12, 2012

(65) Prior Publication Data

US 2012/0270148 A1 Oct. 25, 2012

(30) Foreign Application Priority Data

Apr. 19, 2011 (JP) ..... 2011-093225

(51) Int. Cl.
*G03G 5/00* (2006.01)

(52) U.S. Cl.
USPC ..... 430/137.1; 430/137.15; 430/137.19

(58) Field of Classification Search
USPC ..... 430/137.1, 137.15, 137.19
See application file for complete search history.

(56) References Cited

U.S. PATENT DOCUMENTS

| | | | |
|---|---|---|---|
| 8,029,961 | B2 | 10/2011 | Kuramoto et al. |
| 8,034,526 | B2 | 10/2011 | Watanabe et al. |
| 8,105,742 | B2 | 1/2012 | Norikane et al. |
| 2009/0117486 | A1 | 5/2009 | Watanabe et al. |
| 2009/0239170 | A1 | 9/2009 | Honda et al. |
| 2009/0325100 | A1 | 12/2009 | Watanabe et al. |
| 2010/0003613 | A1 | 1/2010 | Honda et al. |
| 2010/0021209 | A1 | 1/2010 | Watanabe et al. |
| 2010/0227267 | A1 | 9/2010 | Shitara et al. |
| 2011/0007116 | A1 | 1/2011 | Ohgaki |
| 2011/0014565 | A1 | 1/2011 | Norikane et al. |
| 2011/0305987 | A1 | 12/2011 | Yohichiroh et al. |
| 2012/0070777 | A1 | 3/2012 | Makabe et al. |

FOREIGN PATENT DOCUMENTS

| | | |
|---|---|---|
| JP | 2003-262976 | 9/2003 |
| JP | 2007-199463 | 8/2007 |
| JP | 2010-204449 | 9/2010 |

OTHER PUBLICATIONS

U.S. Appl. No. 13/438,375, filed Apr. 3, 2012, Katoh, et al.

*Primary Examiner* — Mark A Chapman
(74) *Attorney, Agent, or Firm* — Oblon, Spivak, McClelland, Maier & Neustadt, L.L.P.

(57) ABSTRACT

A method of manufacturing toner includes forming liquid droplets. The forming liquid droplets includes vibrating a toner constituents liquid in a liquid column resonance liquid chamber having a plurality of nozzles to form a liquid column resonance pressure standing wave therein, and discharging the toner constituents liquid from the nozzles. The method further includes solidifying the liquid droplets. The toner constituents liquid includes an organic solvent and toner constituents dissolved or dispersed in the organic solvent. The toner constituents include a resin, a colorant, and a release agent. The nozzles are disposed within an area including an antinode of the liquid column resonance pressure standing wave. One of the nozzles disposed closer to a node of the liquid column resonance pressure standing wave has a smaller outlet diameter than that disposed farther from the node. The toner constituents liquid is applied with a uniform pressure at a vicinity of each nozzle.

13 Claims, 11 Drawing Sheets

METHOD OF MANUFACTURING TONER, APPARATUS FOR MANUFACTURING TONER, AND METHOD OF MANUFACTURING RESIN PARTICLE

CROSS-REFERENCE TO RELATED APPLICATIONS

This patent application is based on and claims priority pursuant to 35 U.S.C. §119 to Japanese Patent Application No. 2011-093225, filed on Apr. 19, 2011, in the Japanese Patent Office, the entire disclosure of which is hereby incorporated herein by reference.

BACKGROUND

1. Technical Field

The present disclosure relates to a method of manufacturing toner, an apparatus for manufacturing toner, and a method of manufacturing resin particle.

2. Description of Related Art

Pulverization methods are generally known as toner manufacturing methods. In a pulverization method, toner constituents are melt-kneaded by double rolls or a double-axis extruder. The kneaded product is pulverized into coarse particles and the coarse particles are pulverized into fine particles. The fine particles are classified by size and the desired-size particles are collected. The collected particles are further mixed with an external additive, such as a fluidizer, by a HENSCHEL MIXER, if needed. The coarse pulverization can be performed by an instrument such as ROATPLEX and PULVERIZER. The fine pulverization can be performed by an instrument such as JET MILL and TURBO MILL. The classification can be performed by a wind power classifier such as ELBOW-JET CLASSIFIER.

Atomization methods are also known as toner manufacturing methods. In an atomization method, a toner constituents liquid is formed into liquid droplets in a gas phase by the use of an atomizer, such as single-fluid nozzle (pressurized nozzle) atomizer, multi-fluid spray nozzle atomizer, and rotating disc atomizer. The single-fluid nozzle atomizer is configured to atomize a liquid from nozzle holes by application of pressure. The multi-fluid spray nozzle atomizer, such as two-fluid or four-fluid spray nozzle atomizer, is configured to atomize a mixture of a liquid and a compressed gas. The resulting liquid droplets are finer than those resulting from the single-fluid nozzle atomizer. The rotating disc atomizer is configured to form a liquid into liquid droplets by centrifugal force from a rotating disc. The atomization methods can be generally performed by commercially available spray dry systems which are configured to perform atomization and drying simultaneously. When drying by the spray dry system is insufficient, the secondary drying, such as fluidized-bed drying, can be performed. The resulting particles are further mixed with an external additive, such as a fluidizer, by a HENSCHEL MIXER, if needed.

It is likely that toner particles produced by the pulverization or atomization method include a large amount of ultrafine particles, which is not preferable. The ultrafine particles should be removed because they contaminate carrier particles (in two-component developer) and a developing device. As the content of ultrafine particles increases, productivity decreases and production cost increases.

Injection granulation methods are also known as toner manufacturing methods. In an injection granulation method, a liquid is formed into liquid droplets by discharging the liquid from nozzle holes having a diameter similar to a target toner diameter by the use of a vibration generator. Japanese Patent Application Publication No. 2007-199463 describes an injection granulation method which forms liquid columns by discharging a toner constituents liquid from a pressure chamber through nozzles upon application of pressure in a certain direction and dividing the liquid columns into liquid droplets upon application of weak ultrasonic vibration. The toner constituents liquid is supplied to the pressure chamber from a toner constituents liquid container. The toner constituents liquid container has an agitation member for generating a flow of the toner constituents liquid. Due to the generated flow, each toner constituents are kept evenly dispersed in the toner constituents liquid. The toner constituents liquid in the pressure chamber is pressurized in a certain direction and formed into liquid columns through the nozzles. The liquid columns are divided into uniform liquid droplets by inducing the Rayleigh fission by applying weak vibration from a vibration generator. The liquid droplets are then solidified into toner particles. When employing the Rayleigh fission, the liquid is discharged from the nozzles due to vibration as well as pressure. Therefore, the vibration generator has to generate only weak vibration with only low voltage.

In the described method, liquid droplets, formed upon application of pressure to the toner constituents liquid in a certain direction, have a diameter about twice the inner diameter of the nozzle. Therefore, the inner diameter of the nozzle should be smaller when forming small-sized particles, which is more likely to cause nozzle clogging due to the pressure.

Japanese Patent No. 3786034 describes another injection granulation method in which a raw material liquid of toner is discharged from a nozzle by uniformly applying pressure to the raw material liquid retained in a raw material retention part. FIGS. 1A to 1E are views for explaining a mechanism of liquid droplet discharge described in the above reference. A raw material retention part 101 repeatedly goes through the following three states so that liquid droplets are intermittently formed. FIG. 1A is a view of the first state in which a discharge signal is not yet input. A piezoelectric body 102 does not deform, the raw material retention part 101 does not change its volume, and therefore the raw material liquid 103 is not discharged from a nozzle 104. FIGS. 1B and 1C are views of the second state in which a discharge signal is input. The piezoelectric body 103 deforms such that the raw material retention part 101 reduces its volume. In the second state, the raw material retention part 101 instantaneously and uniformly increases its inner pressure and thereby discharges a liquid droplet 105 from the nozzle 104. The raw material retention part 101 is communicated with a raw material storing part, not shown, for storing and feeding the raw material liquid 102. FIGS. 1D and 1E are views of the third state in which one liquid droplet has been discharged. Voltage supply is terminated and the piezoelectric body 103 has returned to its original shape. Due to negative pressure in the raw material retention part 101, the raw material retention part 101 is replenished with the raw material liquid 103 from the raw material storing part.

After being replenished with the raw material liquid 103, the raw material retention part 101 needs to go through the first state in which the raw material liquid 103 is not discharged, which reduces toner productivity.

The method generally produces relatively large liquid droplets. Small liquid droplets can be produced only when the nozzle diameter is relatively small or the toner raw material is diluted. It is likely that a small-diameter nozzle is clogged with solid toner constituents, such as pigment and release agent, thereby reducing production stability. A diluted toner raw material requires a greater amount of energy when being dried, thereby also reducing production stability. When production stability is low, the raw material liquid 103 accumulates in the raw material retention part 101 for an extended period of time, resulting in undesirable fixation of toner constituents to production equipments.

In this method, each raw material retention part 101 has only one nozzle. Provision of a plurality of nozzles may increase productivity but may decrease size uniformity of the produced particles.

SUMMARY

In accordance with some embodiments, a method of manufacturing toner is provided. The method includes forming liquid droplets. The forming liquid droplets includes vibrating a toner constituents liquid in a liquid column resonance liquid chamber having a plurality of nozzles to form a liquid column resonance pressure standing wave therein, and discharging the toner constituents liquid from the nozzles. The method further includes solidifying the liquid droplets. The toner constituents liquid includes an organic solvent and toner constituents dissolved or dispersed in the organic solvent. The toner constituents include a resin, a colorant, and a release agent. The nozzles are disposed within an area including an antinode of the liquid column resonance pressure standing wave. One of the nozzles disposed closer to a node of the liquid column resonance pressure standing wave has a smaller outlet diameter than that disposed farther from the node. The toner constituents liquid is applied with a uniform pressure at a vicinity of each nozzle.

In accordance with some embodiments, an apparatus for manufacturing toner is provided. The apparatus includes a liquid droplet forming device. The liquid droplet forming device includes a liquid column resonance liquid chamber having a plurality of nozzles, and a vibration generator adapted to vibrate a toner constituents liquid in the liquid column resonance liquid chamber to form a liquid column resonance pressure standing wave therein so that the toner constituents liquid is discharged from the nozzles. The apparatus further includes a liquid droplet solidifying device adapted to solidify the liquid droplets. The toner constituents liquid includes an organic solvent and toner constituents dissolved or dispersed in the organic solvent. The toner constituents include a resin, a colorant, and a release agent. The nozzles are disposed within an area including an antinode of the liquid column resonance pressure standing wave. One of the nozzles disposed closer to a node of the liquid column resonance pressure standing wave has a smaller outlet diameter than that disposed farther from the node. The toner constituents liquid is applied with a uniform pressure at a vicinity of each nozzle.

In accordance with some embodiments, a method of manufacturing resin particle is provided. The method includes forming liquid droplets. The forming liquid droplets includes vibrating a liquid in a liquid column resonance liquid chamber having a plurality of nozzles to form a liquid column resonance pressure standing wave therein, and discharging the liquid from the nozzles. The method further includes solidifying the liquid droplets. The liquid is a melted resin or an organic solvent solution or dispersion of a resin. The nozzles are disposed within an area including an antinode of the liquid column resonance pressure standing wave. One of the nozzles disposed closer to a node of the liquid column resonance pressure standing wave has a smaller outlet diameter than that disposed farther from the node, and the liquid is applied with a uniform pressure at a vicinity of each nozzle.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1A:
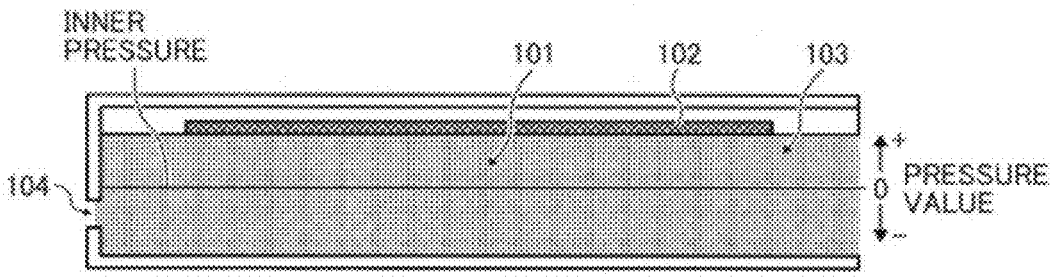
FIG. 1A RELATED ART
FIGS. 1A to 1E are views for explaining a related-art mechanism of liquid droplet discharge.
Figure 1B:
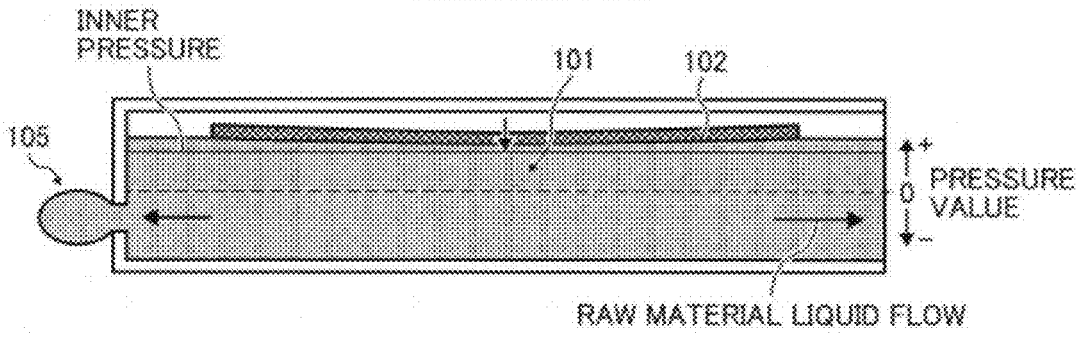
FIG. 1B RELATED ART
Figure 1C:
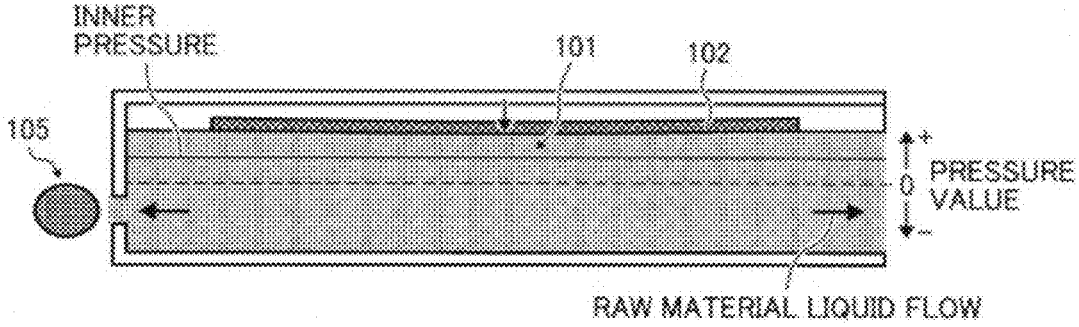
FIG. 1C RELATED ART
Figure 1D:
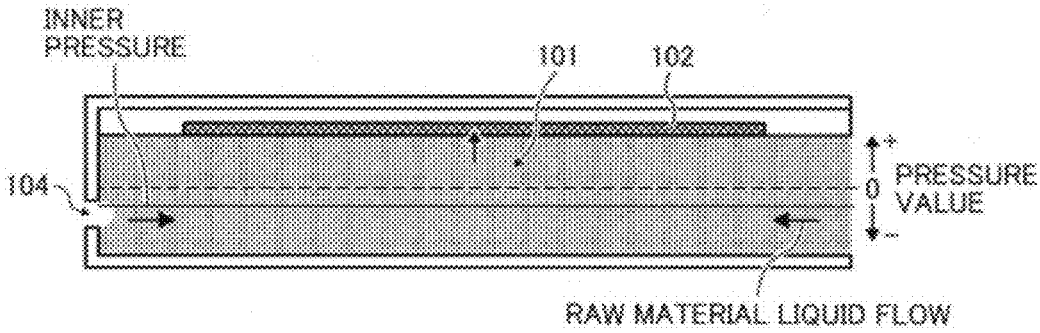
FIG. 1D RELATED ART
Figure 1E:
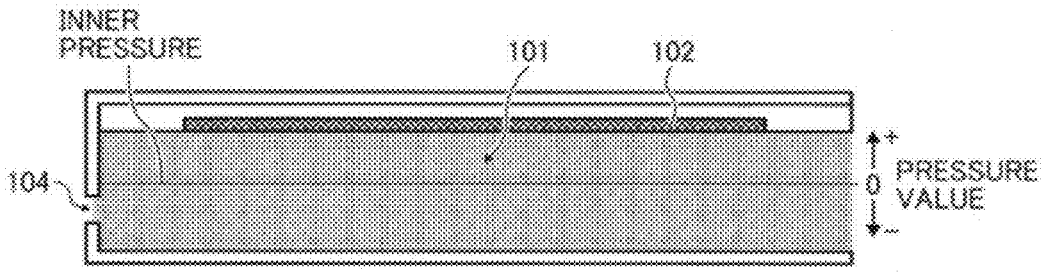
FIG. 1E RELATED ART

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

A method of manufacturing toner according to an embodiment includes at least a process of forming liquid droplets and a process of solidifying the liquid droplets. An apparatus for manufacturing toner according to an embodiment includes at least a liquid droplet forming device and a liquid droplet solidifying device.

The process of forming liquid droplets can be performed by the liquid droplet forming device. In the process of forming liquid droplets, the toner constituents liquid is vibrated in a liquid column resonance liquid chamber having a plurality of nozzles so that a liquid column resonance pressure standing wave is formed therein and the toner constituents liquid is discharged from the nozzles.

The liquid droplet forming device includes a liquid column resonance liquid chamber including a plurality of nozzles and a vibration generator adapted to vibrate a toner constituents liquid in the liquid column resonance liquid chamber to form a liquid column resonance pressure standing wave therein so that the toner constituents liquid is discharged from the nozzles.

The nozzles are disposed within an area including an antinode of the liquid column resonance pressure standing wave. One of the nozzles disposed closer to a node of the liquid column resonance pressure standing wave has a smaller outlet diameter than that disposed farther from the node and the toner constituents liquid is applied with a uniform pressure at a vicinity of each nozzle. In some embodiments, one of the nozzles disposed closest to a liquid common supply path has the smallest outlet diameter.

Within the area including an antinode of the pressure standing wave, the amplitude and variation of pressure variation is large enough to discharge liquid droplets. In some embodiments, the area including an antinode of the pressure standing wave extends from a position of a local maximum amplitude (i.e., a node of the velocity standing wave) toward a distance ±⅓ or ±¼ the wavelength. By providing a plurality of nozzles within the area including an antinode of the pressure standing wave, each of the nozzles discharges uniform liquid droplets at a high efficiency without causing nozzle clogging.

In some embodiments, the number of nozzles disposed to the liquid column resonance liquid chamber is 2 to 100, 2 to 60, or 2 to 20. When the number of nozzles per liquid column resonance liquid chamber is greater than 100, the vibration generator requires a higher voltage in forming the toner constituents liquid into liquid droplets, causing unstable behavior of the vibration generator. When the number of nozzles is within the above-described range, the pressure standing wave is stabilized and stable productivity is provided.

When the number of nozzles per liquid column resonance liquid chamber is greater than two, the toner constituents liquid is applied with a nonuniform pressure at a vicinity of each nozzle, which may result in formation of liquid droplets having a wide size distribution, unless the nozzles are disposed within an area including an antinode of the pressure standing wave with one of the nozzles disposed closer to a node of the liquid column resonance pressure standing wave having a smaller outlet diameter than that disposed farther from the node and the toner constituents liquid being applied with a uniform pressure at a vicinity of each nozzle. In accordance with an embodiment, the toner constituents liquid can be continuously discharged from a plurality of nozzles while forming liquid droplets having a narrow size distribution. Thus, toner particles having a narrow size distribution, which are capable of forming high-definition images, can be effectively produced.

In some embodiments, each of the nozzles has an outlet diameter of 1 to 40 μm, 2 to 15 μm, or 6 to 12 μm. When the outlet diameter is less than 1 μm, the resulting liquid droplets may be too small to be used as toner particles. Moreover, in a case in which the toner constituents liquid includes solid particles such as pigments, the nozzles may be frequently clogged. When the outlet diameter is greater than 40 μm, the resulting liquid droplets may be too large. When such large liquid droplets are dried into toner particles having a weight average particle diameter of about 3 to 6 μm, the toner constituents liquid needs to be diluted with an organic solvent and therefore a large amount of drying energy is required to obtain toner particles, which is undesirable. Nozzles having an outlet diameter of 6 to 12 μm can be formed with a minimized size variation. Such nozzles can be arranged close to each other, which improves productivity.

The "outlet diameter" of a nozzle is defined as the opening diameter on the liquid-droplet-discharging side of the nozzle. When the outlet has a true circle shape, the diameter of the true circle is employed as the outlet diameter of the nozzle. When the outlet has an ellipsoidal or polygonal (e.g., tetragonal, hexagonal, octagonal) shape, the average diameter of the ellipse or polygon is employed as the outlet diameter of the nozzle.

In some embodiments, each of the multiple nozzles has a different shape from the others.

In some embodiments, the nozzle has a tapered shape having a predetermined taper angle such that the opening diameter of the nozzle is gradually reduced from the inlet toward the outlet. The taper angle is formed between the opening axis and a side surface of the nozzle in a cross-section in the thickness direction. The opening axis is a perpendicular line to the surface on which the nozzles are disposed. The taper may be either linear taper, exponential taper, parabolic taper, or a combination thereof.

In some embodiments, the interval between the nozzles, i.e., the shortest distance between the centers of adjacent nozzles, is 20 to 200 μm, 40 to 135 μm, or 40 to 80 μm. When the interval is less than 20 μm, liquid droplets discharged from adjacent nozzles are likely to collide with each other, resulting in production of toner particles having a wide particle size distribution.

In one or more embodiments, all the adjacent nozzles are disposed at the same interval. In some embodiments, the interval between at least one pair of adjacent nozzles is different from those between the other pairs of adjacent nozzles.

According to an embodiment, the toner constituents liquid is applied with a uniform pressure at a vicinity of each nozzle. When the toner constituents liquid is applied with a pressure at a vicinity of each nozzle with the rate of pressure variability of 0 to 5% at a certain resonant frequency, the pressure is regarded as being uniform. The rate of variability is calculated from a later-described fluid calculation. In some embodiments, the rate of pressure variability is 0 to 3%. The vicinity of each nozzle is defined as a space extending from the opening of the nozzle for a distance of 10 μm within the liquid column resonance liquid chamber.

The liquid column resonance liquid chamber is adapted to contain a liquid and to form a pressure standing wave in the liquid when vibration is applied to the liquid from the vibration generator, based on a mechanism of liquid column resonance. The liquid column resonance liquid chamber has a plurality of nozzles within an area including an antinode of the pressure standing wave. The liquid column resonance liquid chamber has a communication opening on one longitudinal end thereof. The liquid column resonance liquid chamber may have a reflective wall surface, being perpendicular to the longitudinal axis, on at least a part of one longitudinal end, if needed. The vibration generator may be disposed on one wall surface of the liquid column resonance liquid chamber which is parallel to the longitudinal direction of the liquid column resonance liquid chamber. The nozzles may be disposed on a wall surface which is facing the wall surface having the vibration generator.

The liquid column resonance liquid chamber may have a shape of quadrangular prism, circular cylinder, or frustum of circular cone, for example.

In some embodiments, the liquid column resonance liquid chamber has reflective wall surfaces on both longitudinal ends. The reflective wall surface is formed of a hard material which can reflect the acoustic wave in liquid, such as metallic materials (e.g., aluminum, stainless steel) or silicone materials.

A length (represented by L in FIG. 3, to be described in detail later) between both longitudinal ends of the liquid column resonance liquid chamber is determined based on a mechanism of liquid column resonance to be described in detail later. A width (represented by W in FIG. 4, to be described in detail later) of the liquid column resonance liquid chamber may be smaller than a half of the length (L) so as not to give excessive frequency to the liquid column resonance.

In some embodiments, the liquid column resonance liquid chamber is formed of joined frames formed of a material having a high stiffness which does not adversely affect liquid resonant frequency of the toner constituent liquid at drive frequency. Specific examples of such materials include metals, ceramics, and silicones, for example.

In some embodiments, the liquid droplet forming device includes a plurality of liquid column resonance liquid chambers to drastically improve manufacturability. In some embodiments, the number of liquid column resonance liquid chambers per liquid droplet forming device is 100 to 2,000, 100 to 1,000, or 100 to 400, so that operability and manufacturability go together.

The vibration generator is adapted to apply vibration to the toner constituents liquid in the liquid column resonance liquid chamber and is driven at a predetermined frequency. The vibration generator may comprise a piezoelectric body or an ultrasonic vibration generating body, for example.

The piezoelectric body may comprise a piezoelectric ceramic such as lead zirconate titanate (PZT), a piezoelectric polymer such as polyvinylidene fluoride (PVDF), crystal, or a single crystal of $LiNbO_3$, $LiTaO_3$, or $KNbO_3$, for example. The ultrasonic vibration generating body may comprise a magnetostrictor, for example.

The vibration generator may be affixed to an elastic plate. The elastic plate may constitute a part of the wall of the liquid column resonance liquid chamber so as not to bring the vibration generator into contact with the toner constituent liquid.

The vibration generator in each liquid column resonance liquid chamber may be independently controllable. Alternatively, a blockish vibration generator, such as a piezoelectric body, may be arranged through the intermediary of the elastic plate to fit the arrangement of the liquid column resonance liquid chambers so that each liquid column resonance liquid chamber is independently controllable.

Figure 2:
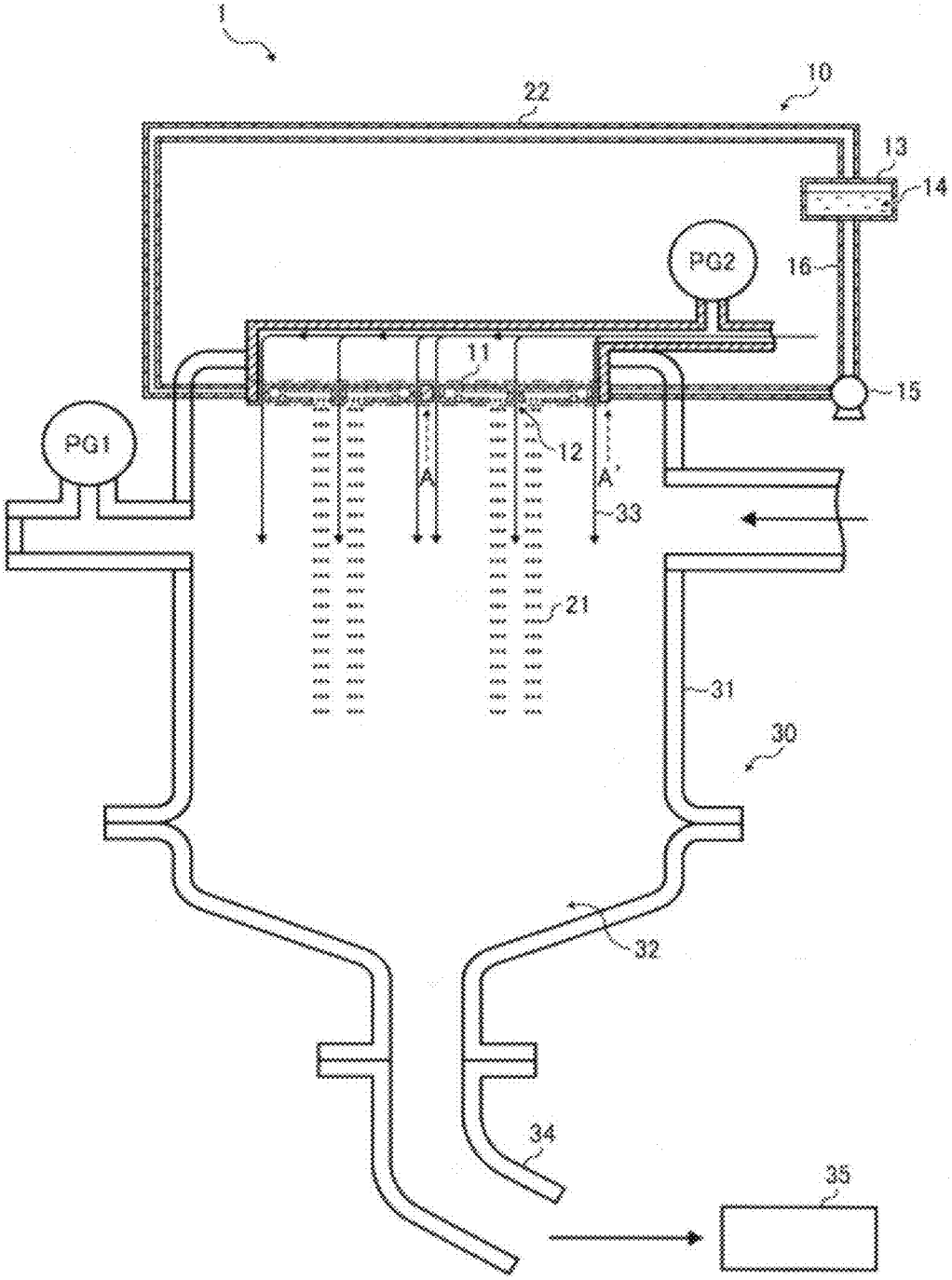
FIG. 2 is a cross-sectional view of an apparatus for manufacturing toner according to an embodiment.
Figure 3:
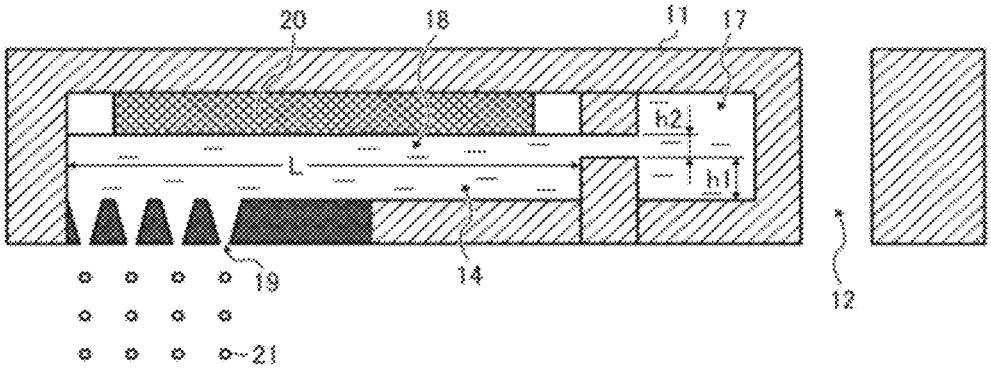
FIG. 3 is a cross-sectional view of a liquid droplet discharge head in a liquid droplet forming unit illustrated in FIG. 2.

A mechanism of liquid column resonance generated in the liquid column resonance liquid chamber is described below with reference to FIGS. 2 and 3. FIG. 2 is a schematic view of an apparatus for manufacturing toner according to an embodiment. FIG. 3 is a magnified view of a liquid droplet discharge head 11 in the apparatus illustrated in FIG. 2. Referring to FIG. 3, the resonant wavelength λ is represented by the following formula (A):

$$\lambda = c/f \tag{A}$$

wherein c represents a sonic speed in a toner constituents liquid 14 in a liquid column resonance liquid chamber 18 and f represents a drive frequency given to the toner constituents liquid 14 from a vibration generator 20.

When both ends of the liquid column resonance liquid chamber 18 are closed or equivalent to closed ends, a length between reflective wall surfaces disposed on both longitudinal ends of the liquid column resonance liquid chamber 18 is defined as the longitudinal length L of the liquid column resonance liquid chamber 18. In these cases, resonance most effectively occurs when the length L is an even multiple of λ/4. The length L is represented by the following formula (B):

$$L = (N/4)\lambda \tag{B}$$

wherein N represents an even number.

An end being equivalent to a closed end is defined as an end at which pressure cannot be released. Such an end includes, for example, an end having a reflective wall surface and a communication opening for supplying the toner constituents liquid with the height of the reflective wall surface being more than twice the height of the communication opening, or with the area of the reflective wall surface being more than twice the area of the communication opening.

In FIG. 3, L represents a length between the closed end of the frame of the liquid column resonance liquid chamber 18 and the other end thereof closer to a liquid common supply path 17. The height h1 (about 80 μm) of the frame at the end of the liquid column resonance liquid chamber 18 closer to the liquid common supply path 17 is about twice as much as the height h2 (about 40 μm) of the communication opening. Therefore, in the present embodiment, both ends are regarded as being equivalent to closed ends.

The formula (B) is also satisfied when both ends of the liquid column resonance liquid chamber 18 are completely open or equivalent to open ends. Similarly, when one end is open or equivalent to an open end at which pressure can be released, and the other end is closed, resonance most effectively occurs when the length L is an odd multiple of λ/4. In this case, the length L is represented by the formula (B) as well, wherein N represents an odd number.

Thus, the most effective drive frequency f is derived from the formulae (A) and (B) and represented by the following formula (1):

$$f = N \times c/(4L) \tag{1}$$

wherein L represents a longitudinal length of the liquid column resonance liquid chamber 18, c represents a sonic speed in the toner constituents liquid, and N represents a natural number.

In the present embodiment, a vibration having a frequency f derived from the formula (1) is applied to the toner constituent liquid. Actually, vibration is not infinitely amplified because the toner constituents liquid attenuates resonance due to its viscosity. Therefore, resonance can occur even at a frequency represented by the later-described formula (2) or (3), being around the most effective drive frequency f represented by the formula (1).

Figure 5A:
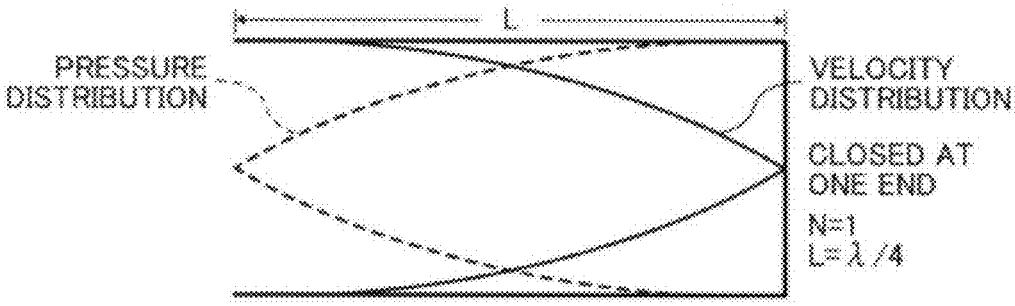
FIGS. 5A to 5D are views of wave configurations (i.e., resonant modes) of velocity and pressure standing waves when N is 1, 2, or 3.
Figure 5B:
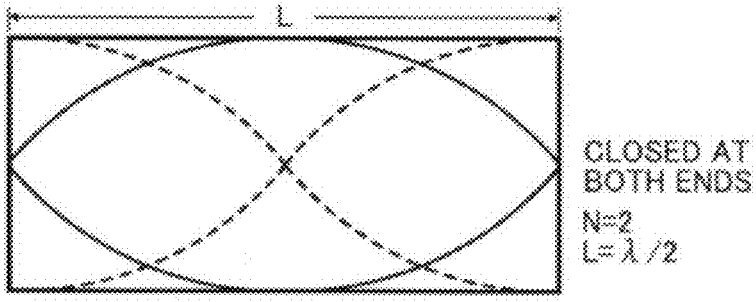
Figure 5C:
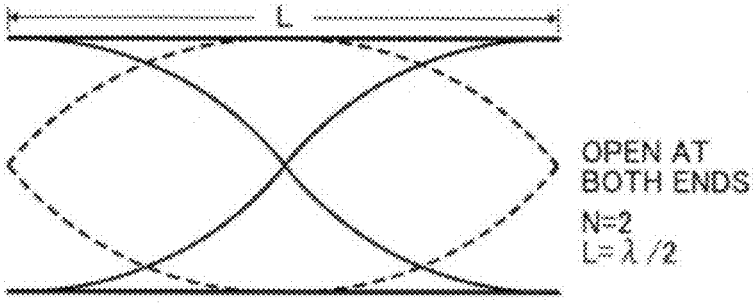
Figure 5D:
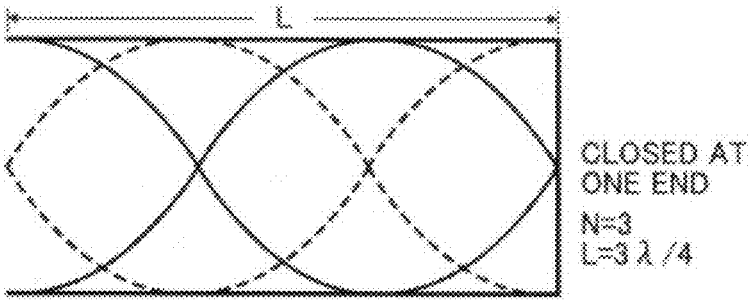
Figure 6A:
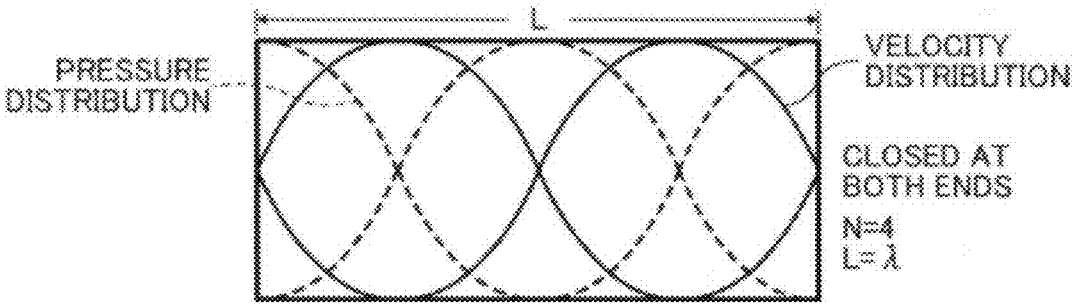
FIGS. 6A to 6C are views of wave configurations (i.e., resonant modes) of velocity and pressure standing waves when N is 4 or 5.
Figure 6B:
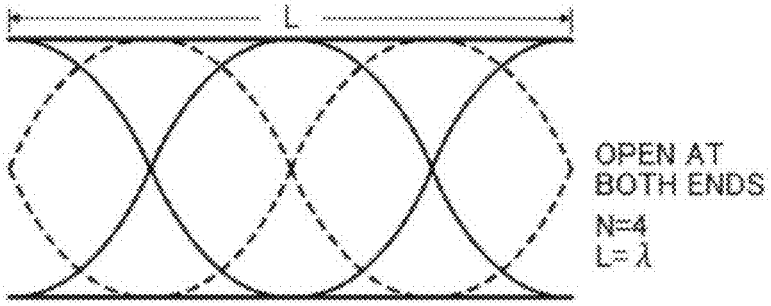
Figure 6C:
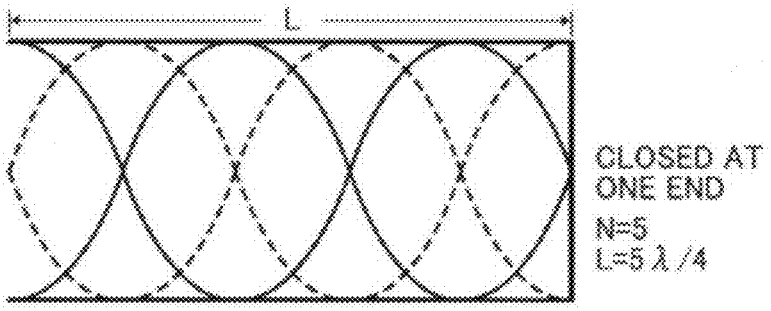

FIGS. 5A to 5D are views of wave configurations (i.e., resonant modes) of velocity and pressure standing waves when N is 1, 2, or 3. FIGS. 6A to 6C are views of wave configurations (i.e., resonant modes) of velocity and pressure standing waves when N is 4 or 5. The standing waves are longitudinal waves in actual but are illustrated as transversal waves in FIGS. 5A to 5D and FIGS. 6A to 6C for the sake of simplicity. In FIGS. 5A to 5D and FIGS. 6A to 6C, solid lines represent velocity standing waves and dotted lines represent pressure standing waves. Referring to FIG. 5A, when one end is closed and N is 1, amplitude of the velocity standing wave is zero at the closed end and is maximum at the open end. When L represents the longitudinal length of the liquid column resonance liquid chamber 18 and λ represents the liquid column resonant wavelength of the toner constituents liquid, standing waves most effectively occur when the natural number N is 1 to 5. Wave configurations of the standing waves depend on whether or not either end is open/closed. The condition of either end depends on conditions of nozzles and/or supply openings. In acoustics, an open end is defined as a point at which longitudinal velocity of a medium (e.g., a liquid) is maximum and pressure thereof is zero. A closed end is defined as a point at which longitudinal velocity of the medium is zero. The closed end is acoustically considered as a hard wall that reflects waves. Resonant standing waves as illustrated in FIGS. 5A to 5D and FIGS. 6A to 6C occur when each end is ideally completely closed or open. Configurations of standing waves vary depending on the number and/or arrangement of the nozzles. Thus, resonant frequency can appear even at a position displaced from the position derived from the formula (1). Even in such cases, stable discharge conditions can be provided by adjusting the drive frequency. For example, when the sonic speed c in the toner constituents liquid is 1,200 m/s, the length L between both ends of the liquid column resonance liquid chamber 18 is 1.85 mm, both ends are fixed with wall surfaces, i.e., both ends are closed, and N is 2, the most effective resonant frequency is derived from the formula (B) as 324 kHz. As another example, when the sonic speed c in the toner constituents liquid is 1,200 m/s, the length L between both ends of the liquid column resonance liquid chamber 18 is 1.85 mm, both ends are fixed with wall surfaces, i.e., both ends are closed, and N is 4, the most effective resonant frequency is derived from the formula (B) as 648 kHz. Thus, higher resonance can occur in the single liquid column resonance liquid chamber 18 by adjusting the drive frequency.

In some embodiments, the vibration has a high frequency of 30 kHz or more, or 300 kHz to 1,000 kHz.

In some embodiments, both ends of the liquid column resonance liquid chamber 18 are equivalent to closed ends or are regarded as being acoustically soft walls due to the influence of the nozzle openings, both of which increases frequency. Of course, both ends may be equivalent to open ends. The influence of the nozzle openings means a lesser acoustic impedance and a greater compliance component. When the liquid column resonance liquid chamber 18 has wall surfaces on both longitudinal ends, as illustrated in FIG. 5B or FIG. 6A, all possible resonant modes are available as if both ends are closed or one end is open.

Referring back to FIG. 3, the drive frequency depends on the number, arrangement, and/or cross-sectional shape of nozzles 19. For example, as the number of the nozzles 19 increases, the closed ends of the liquid column resonance liquid chamber 18 are gradually released from restriction. As a result, a resonant standing wave is generated as if both ends are substantially open and the drive frequency is increased. The restriction releases from the position of one of the nozzles 19 disposed closest to a liquid supply path 17. As another example, when each of the nozzles 19 has a round cross-sectional shape or the volume of each nozzle 19 is varied by varying the frame thickness, the actual standing wave has a short wavelength which has a higher frequency than the drive frequency. Upon application of voltage to the vibration generator 20 with the drive frequency thus determined, the vibration generator 20 deforms so as to generate a resonant standing wave most effectively. A liquid column resonance standing wave can generate even at a frequency around the most effective drive frequency for generating a resonant standing wave. When the vibration generator 20 vibrates at a drive frequency f satisfying the following formulae (2) and (3), a liquid column resonance is generated and liquid droplets are discharged from the nozzles 19:

$$N \times c/(4L) \leq f \leq N \times c/(4Le) \quad (2)$$

$$N \times c/(4L) \leq f \leq (N+1) \times c/(4Le) \quad (3)$$

wherein L represents a longitudinal length of the liquid column resonance liquid chamber 18, Le represents a distance between a longitudinal end of the liquid column resonance liquid chamber 18 closer to the liquid common supply path 17 and the center of the nozzle 19 closest to the longitudinal end, c represents a sonic speed in the toner constituents liquid, and N represents a natural number.

In some embodiments, Le/L>0.6 is satisfied.

Based on the above-described mechanism of liquid column resonance, a pressure standing wave is formed in the liquid column resonance liquid chamber 18 and liquid droplets are continuously discharged from the nozzles 19 disposed to the liquid column resonance liquid chamber 18 within an area including an antinode of the pressure standing wave.

The process of solidifying liquid droplets can be performed by the liquid droplet solidifying device. The liquid droplet solidifying device is adapted to solidify liquid droplets. The process of solidifying liquid droplets may be, for example, a process in which organic solvents are evaporated from liquid droplets into dried gas so that the liquid droplets are contracted and solidified.

In some embodiments, in the process of solidifying liquid droplets, the liquid droplets are conveyed by an air current. In accordance with such embodiments, the liquid droplet solidifying device may have an air current path adapted to flow an air current downstream from an outer periphery of the liquid column resonance liquid chamber 18 relative to a direction of discharge of the liquid droplets.

In accordance with some embodiments, the air current has a greater velocity than an initial discharge velocity of the liquid droplets.

Figure 4:
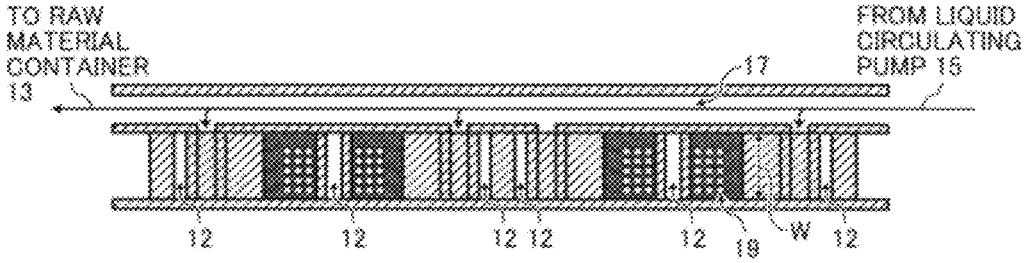
FIG. 4 is a cross-sectional view of the liquid droplet forming unit illustrated in FIG. 2 taken along the line A-A'.

An apparatus for manufacturing toner according to an embodiment is described in detail with reference to FIGS. 2 to 4. FIG. 2 is a cross-sectional view of an apparatus for manufacturing toner according to an embodiment. FIG. 3 is a cross-sectional view of a liquid droplet discharge head in a liquid droplet forming unit illustrated in FIG. 2. FIG. 4 is a cross-sectional view of the liquid droplet forming unit illustrated in FIG. 2 taken along the line A-A'. Referring to FIG. 2, a toner manufacturing apparatus 1 has a liquid droplet discharge unit 10 and a drying collecting unit 30. The liquid droplet forming unit 10, serving as the liquid droplet forming device, has multiple liquid droplet discharge heads 11. Referring to FIG. 3, each liquid droplet discharge head 11 is adapted to discharge the toner constituents liquid 14 into toner liquid droplets 21 from the liquid column resonance liquid chamber 18 through the nozzles 19. The liquid column resonance liquid chamber 18 has a liquid droplet discharging area communicated with an outside through the nozzles 19. On both sides of each liquid droplet discharge head 11, airflow pathways 12 are disposed through which an airflow generated from an airflow generator passes so that the toner liquid droplets 21 are guided to the drying collecting unit 30. The liquid droplet forming unit 10 also has a raw material container 13 for containing the toner constituents liquid 14, and a liquid circulating pump 15 adapted to pump the toner constituents liquid 14 from the raw material container 13 to a liquid common supply path 17 through a liquid supply path 16 and to return the toner constituents liquid 14 from the liquid supply path 16 to the raw material container 13 through a liquid return pipe 22. As illustrated in FIG. 3, each liquid droplet discharge head 11 includes the liquid common supply path 17 and the liquid column resonance liquid chamber 18. The liquid column resonance liquid chamber 18 is communicated with the liquid common supply path 17 disposed on its one end wall surface in a longitudinal direction. The liquid column resonance liquid chamber 18 has the nozzles 19, adapted to discharge toner liquid droplets 21, on its one wall surface which is connected with its both longitudinal end wall surfaces. The liquid column resonance liquid chamber 18 also has the vibration generator 20, adapted to generate high-frequency vibration for forming a liquid column resonance standing wave, on the wall surface facing the nozzles 19. The vibration generator 20 is connected to a high-frequency power source.

The drying collecting unit 30 has a chamber 31 and a toner collecting part 32. Within the chamber 31, an air current generated from an air current generator and a descending air current 33 join together to form a large descending air current. The toner liquid droplets 21 discharged from the liquid droplet discharge heads 11 are conveyed downward not only by gravity but also by the descending air current 33. Thus, the toner liquid droplets 21 are prevented from decelerating by air resistance. When toner liquid droplets 21 are continuously discharged, preceding liquid droplets are prevented from decelerating by air resistance. Therefore, subsequent liquid droplets are prevented from catching up and coalescing with the preceding liquid droplets. The air current may be generated by applying pressure to the chamber 31 from an air blower provided upstream from the chamber 31 or reducing pressure in the chamber 31 by sucking the chamber 31 from the toner collecting part 32. Within the toner collecting part 32, a rotating air current generator may be disposed adapted to generate a rotating air current rotatable around an axis parallel to the vertical direction. The chamber 31 is connected to a toner retention part 35 for retaining dried and solidified toner particles collected through a toner collecting tube 34.

A method of manufacturing toner according to an embodiment is described in detail below. Referring to FIGS. 2 and 3, the liquid circulating pump 15 supplies the toner constituents liquid 14 from the raw material container 13 to the liquid common supply path 17 through the liquid supply path 16. The toner constituents liquid 14 is further supplied to the liquid column resonance liquid chamber 18 disposed in the liquid droplet discharge head 11. Within the liquid column resonance liquid chamber 18 filled with the toner constituents liquid 14, the vibration generator 20 vibrates to form a liquid column resonance pressure standing wave while forming a pressure distribution therein. Thus, toner liquid droplets 21 are discharged from the nozzles 19 disposed within an area including an antinode of the pressure standing wave.

After passing the liquid common supply path 17, the toner constituents liquid 14 flows into the liquid return pipe 22 and returns to the raw material container 13. As the toner liquid droplets 21 are discharged, the amount of the toner constituents liquid 14 in the liquid column resonance liquid chamber 18 is reduced and suction force generated by the action of the liquid column resonance standing wave is also reduced within the liquid column resonance liquid chamber 18. Thus, the liquid common supply path 17 temporarily increases the flow rate of the toner constituents liquid 14 to fill the liquid column resonance liquid chamber 18 with the toner constituents liquid 14. After the liquid column resonance liquid chamber 18 is refilled with the toner constituents liquid 14, the flow rate of the toner constituents liquid 14 in the liquid common supply path 17 is returned. The toner constituents liquid 14 then starts circulating through the liquid supply path 16 and the liquid return pipe 22 again. The toner liquid droplets 21 discharged from the liquid droplet discharge heads 11 are conveyed downward not only by gravity but also by the descending air current 33 formed from an air current generated from the air current generator that passes through the airflow pathways 12. A combination of a rotating air current generated from the rotating air current generator disposed within the toner collecting part 32 and the descending air current 33 forms a spiral air current along a conical inner wall surface of the toner collecting part 32. The spiral air current dries and solidifies the toner liquid droplets 21 into toner particles. The toner particles thus formed are retained in the toner retention part 35 through the toner collecting tube 34.

As illustrated in FIG. 4, a plurality of the nozzles 19 may be disposed in the width direction of the liquid column resonance liquid chamber 18, which improves production efficiency. The liquid column resonant frequency varies depending on the arrangement of the nozzles 19. Thus, the liquid column resonant frequency may be varied in accordance with the nozzle arrangement and corresponding liquid droplets discharge condition.

Details of liquid column resonance phenomenon occurring in the liquid column resonance liquid chamber 18 are described with reference to FIGS. 7A to 7E. In FIGS. 7A to 7E, solid lines represent velocity distributions at arbitrary points within the liquid column resonance liquid chamber 18. With respect to velocity, the direction from the liquid common supply path 17 side toward the liquid column resonance liquid chamber 18 is defined as the plus (+) direction and the opposite direction is defined as the minus (−) direction. Dotted lines represent pressure distributions at arbitrary points within the liquid column resonance liquid chamber 18. A positive (+) pressure and a negative (−) pressure relative to atmospheric pressure respectively create downward and upward pressures in FIGS. 7A to 7E. In FIGS. 7A to 7E, the height (equivalent to h1 in FIG. 3) of the end of the frame of the liquid column resonance liquid chamber 18 closer to the liquid common supply path 17 is more than twice as the height (equivalent to h2 in FIG. 3) of the communication opening between the liquid column resonance liquid chamber 18 and the liquid common supply path 17. Therefore, it can be assumed that both ends of the liquid column resonance liquid chamber 18 are approximately closed.

Figure 7A:
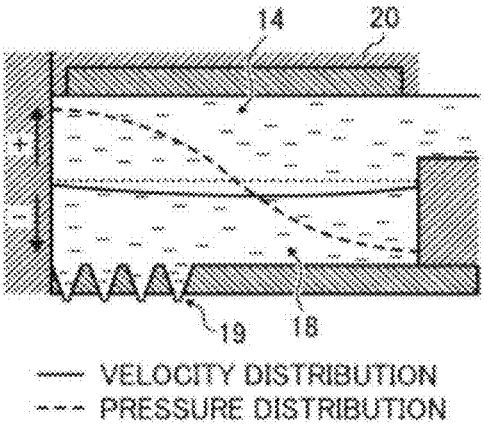
FIGS. 7A to 7E are views for explaining liquid column resonance phenomenon occurring in a liquid column resonance liquid chamber.
Figure 7B:
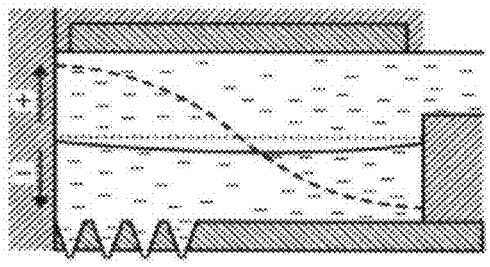
Figure 7C:
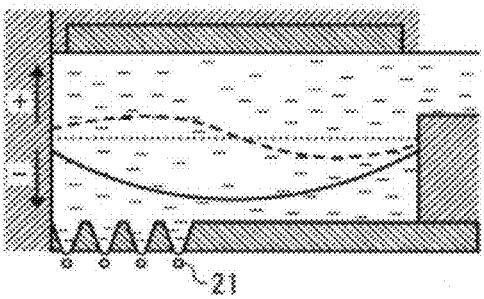

In FIG. 7A, pressure and velocity wave configurations within the liquid column resonance liquid chamber 18 are illustrated at the time liquid droplets are being discharged. In FIG. 7B, pressure and velocity wave configurations within the liquid column resonance liquid chamber 18 are illustrated immediately after liquid droplets have been discharged and the liquid has drawn back. In FIGS. 7A and 7B, the pressure within the liquid column resonance liquid chamber 18 becomes maximal at the position where the nozzles 19 are disposed. Within the liquid column resonance liquid chamber 18, the toner constituents liquid 14 flows in a direction toward the liquid common supply path 17 with a low velocity. Thereafter, as illustrated in FIG. 7C, the positive pressure around the nozzles 19 decreases toward negative pressures. Within the liquid column resonance liquid chamber 18, the toner constituents liquid 14 still flows in a direction toward the liquid common supply path 17 side but with a maximum velocity.

Figure 7D:
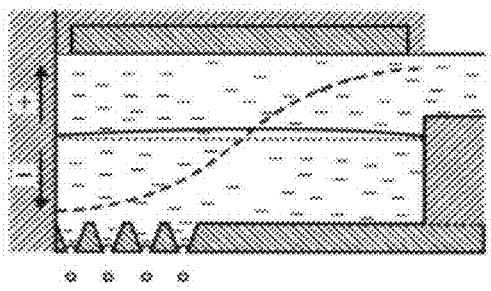
Figure 7E:
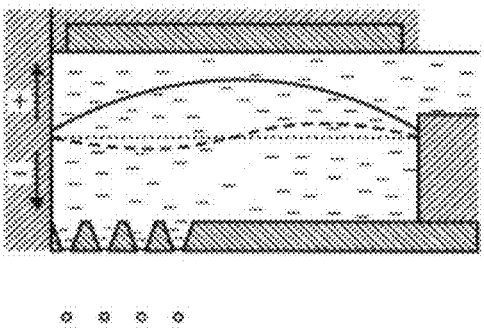

Thereafter, as illustrated in FIG. 7D, the pressure around the nozzles 19 becomes minimal. Within the liquid column resonance liquid chamber 18, the toner constituents liquid 14 flows in a direction from the liquid common supply path 17 side toward the liquid column resonance liquid chamber 18 side with a low velocity. From this time, filling the liquid column resonance liquid chamber 18 with the toner constituents liquid 14 is started. Thereafter, as illustrated in FIG. 7E, the negative pressure around the nozzles 19 increases in a direction toward positive pressures. Within the liquid column resonance liquid chamber 18, the toner constituents liquid 14 still flows in a direction toward the liquid common supply path 17 side but with a maximum velocity. At this time, filling the liquid column resonance liquid chamber 18 with the toner constituents liquid 14 is terminated. Thereafter, as illustrated in FIG. 7A, the pressure within the liquid column resonance liquid chamber 18 becomes maximal again at the position where the nozzles 19 are disposed so as to start discharging liquid droplets 21 again. In summary, a standing wave is generated in liquid column resonance caused by a high-frequency driving of the generation vibrator 20 within the liquid column resonance liquid chamber 18. The nozzles 19 are disposed within an area including an antinode of the standing wave at which the pressure amplitude becomes maximal. Thus, toner liquid droplets 21 are continuously discharged from the nozzles 19 in accordance with the cycle of the antinodes.

Figure 8:
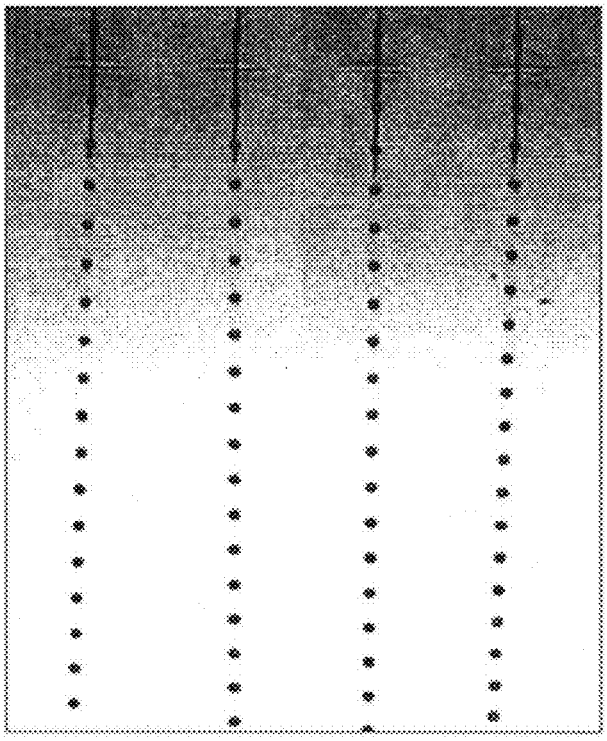
FIG. 8 is a photograph showing liquid droplet discharge phenomenon obtained by laser shadowgraphy.
Figure 9:
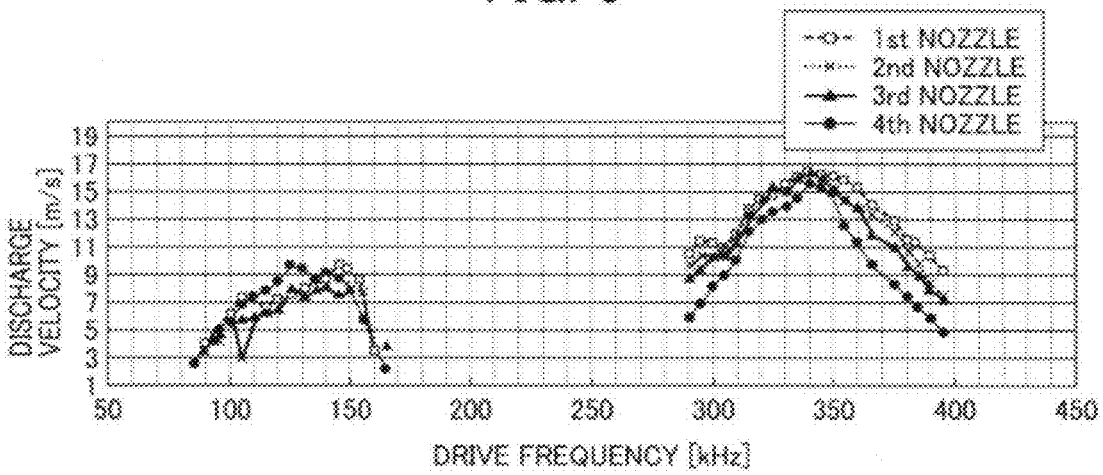
FIG. 9 is a graph showing relations between drive frequency and discharge velocity.

In one embodiment, the length L between both longitudinal ends of the liquid column resonance liquid chamber 18 is 1.85 mm and the resonant mode N is 2. The first to fourth nozzles are disposed within an area including an antinode of the pressure standing wave, and the drive wave is a sine wave having a drive frequency of 340 kHz. FIG. 8 is a photograph showing liquid droplet discharge phenomenon according to this embodiment obtained by laser shadowgraphy. It is clear from FIG. 8 that the discharged liquid droplets are very uniform in both particle size and discharge velocity. FIG. 9 is a graph showing relations between drive frequency and discharge velocity when the drive wave is sine waves having a driving frequency between 290 and 395 kHz with the same amplitude. It is clear from FIG. 9 that the discharge velocities at all the first to fourth nozzles become maximal and uniform when the drive frequency is around 340 kHz. Accordingly, it is clear that the liquid droplet discharge phenomenon occurs at the position corresponding to antinodes of the standing wave having a frequency of 340 kHz that is the second resonant mode of liquid column resonance. It is also clear from FIG. 9 that liquid droplet discharge phenomenon does not occur between the first resonant mode around drive frequencies of 130 kHz and the second resonant mode around drive frequencies of 340 kHz, at each of which the discharge velocity becomes local maximum.

Figure 10:
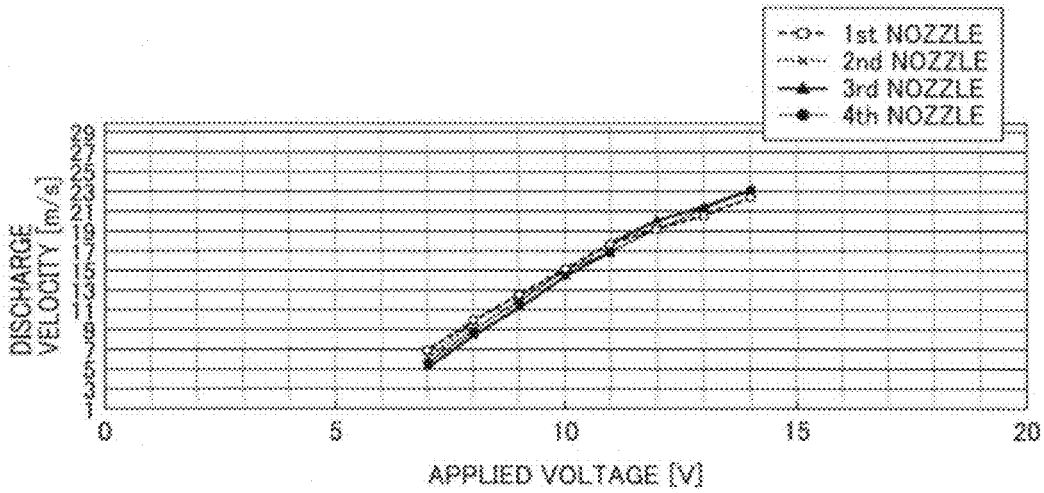
FIG. 10 is a graph showing relations between applied voltage and discharge velocity.
Figure 11:
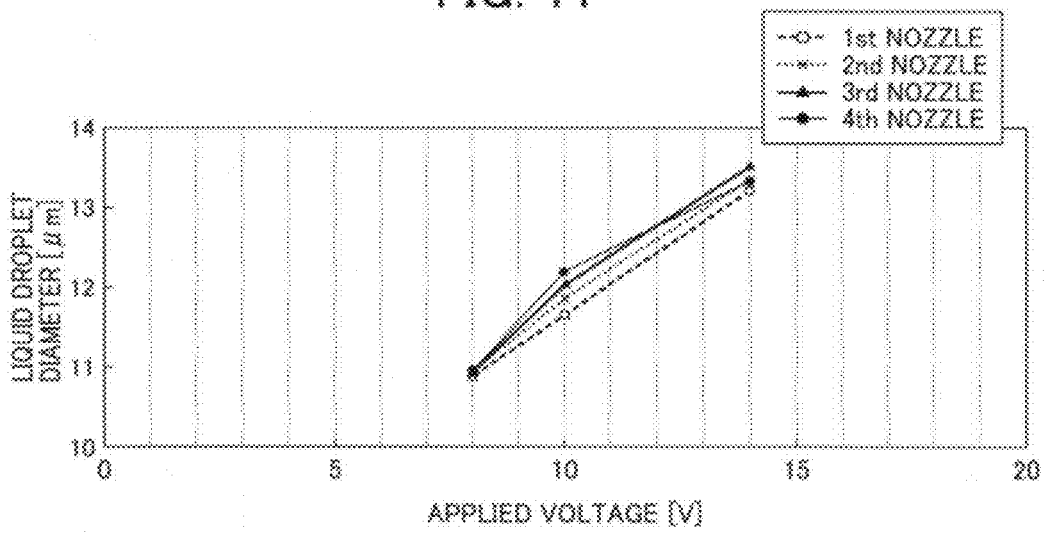
FIG. 11 is a graph showing relations between applied voltage and liquid droplet diameter.

FIG. 10 is a graph showing relations between applied voltage and discharge velocity. FIG. 11 is a graph showing relations between applied voltage and liquid droplet diameter. It is clear from FIGS. 10 and 11 that both discharge velocity and liquid droplet diameter monotonically increase as applied voltage increases. Thus, both discharge velocity and liquid droplet diameter can be arbitrarily adjusted by controlling the applied voltage.

When the number of nozzles per liquid column resonance liquid chamber is greater than two, the toner constituents liquid is applied with a nonuniform pressure at a vicinity of each nozzle, which may result in formation of liquid droplets having a wide size distribution, unless the nozzles are disposed within an area including an antinode of the pressure standing wave with one of the nozzles disposed closer to a node of the liquid column resonance pressure standing wave having a smaller outlet diameter than that disposed farther from the node and the toner constituents liquid being applied with a uniform pressure at a vicinity of each nozzle. In accordance with an embodiment, the toner constituents liquid can be continuously discharged from a plurality of nozzles while forming liquid droplets having a narrow size distribution. Thus, toner particles having a narrow size distribution, which are capable of forming high-definition images, can be effectively produced.

The above-described method and apparatus according to some embodiments are adapted to produce toner particles having a small particle diameter and a narrow size distribution capable of producing high-definition images for an extended period of time. External additives such as fluidity improving agent and cleanability improving agent may be added to the toner particles.

In some embodiments, the toner particles have a size distribution, represented by the ratio of the weight average particle diameter to the number average particle diameter, of 1.00 to 1.15 or 1.00 to 1.05. In some embodiments, the toner particles have a weight average particle diameter of 1 to 20 μm, 2 to 10 μm, or 3 to 6 μm.

Size distribution of toner particles can be measured by a flow particle image analyzer FPIA-2000 (from Sysmex Corporation), for example. An exemplary measurement procedure using FPIA-2000 is described below. First, add several drops of a nonionic surfactant (preferably CONTAMINON N from Wako Pure Chemical Industries, Ltd.) to 10 ml of water from which fine foreign substances have been previously removed by a filter and, as a result, containing particles having a circle-equivalent diameter which fall within the measuring range (e.g., not less than 0.60 μm and less than 159.21 μm) in a number only 20 or less per $10^{-3}$ $cm^3$. Add 5 mg of a sample (e.g., toner particles) to the water and subject the resulting liquid to a dispersion treatment for 1 minute at 20 kHz and 50 W/10 $cm^3$ using an ultrasonic disperser UH-50 (from SMT Corporation). Further subject the liquid to the dispersion treatment for 5 minutes in total. Thus, a sample dispersion is prepared containing 4,000 to 8,000 sample particles having a circle-equivalent diameter which fall within the measuring range of not less than 0.60 μm and less than 159.21 μm per $10^{-3}$ $cm^3$.

Next, let the sample dispersion pass through a flow path of a flat transparent flow cell having a thickness of about 200 μm. A stroboscopic lamp and a CCD camera are respectively provided on opposite sides of the flow cell so that an optical path is formed crossing the thickness direction of the flow cell. While the sample dispersion is flowing, let the stroboscopic lamp emit light at an interval of 1/30 seconds to obtain a two-dimensional image of the particles flowing in the flow cell that is parallel to at least a part of the flow cell. Calculate circle-equivalent diameter of each particle from the diameter of a circle having the same area as the two-dimensional image of the particle.

More than 1,200 particles can be subjected to the measurement of circle-equivalent diameter in about 1 minute in the above procedure. Thus, a number distribution and a ratio (% by number) of particles having a specific circle-equivalent diameter can be determined. In the resulting frequency and cumulative distributions (%), a range of 0.06 to 400 μm is divided into 226 channels (i.e., 1 octave is divided into 30 channels). The actual measuring range is not less than 0.60 μm and less than 159.21 μm.

The toner constituents liquid includes an organic solvent and toner constituents dissolved or dispersed in the organic solvent. The toner constituents include at least a resin, a colorant, and a release agent, and optionally include a charge controlling agent, etc.

For example, the toner constituents liquid can be prepared by dissolving a resin, such as a styrene-acrylic resin, a polyester resin, a polyol resin, or an epoxy resin in an organic solvent, and further dispersing toner constituents, such as a colorant, a release agent, and an optional charge controlling agent in the organic solvent. The toner constituents liquid is formed into liquid droplets and solidified into toner particles by the method or apparatus according to some embodiments. External additives such as fluidity improving agent and cleanability improving agent may be added to the toner particles.

The resin includes at least a binder resin. Specific examples of usable binder resins include, but are not limited to, vinyl homopolymers and copolymers obtainable from styrene monomers, acrylic monomers, and/or methacrylic monomers, polyester polymers, polyol resins, phenol resins, silicone resins, polyurethane resins, polyamide resins, furan resins, epoxy resins, xylene resins, terpene resins, coumarone indene resins, polycarbonate resins, and petroleum resins.

Specific examples of usable styrene monomers include, but are not limited to, styrene, o-methylstyrene, m-methylstyrene, p-methylstyrene, p-phenylstyrene, p-ethylstyrene, 2,4-dimethylstyrene, p-n-amylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, p-nitrostyrene, and derivatives thereof.

Specific examples of usable acrylic monomers include, but are not limited to, acrylic acid and acrylates. Specific examples of usable acrylates include, but are not limited to, methyl acrylate, ethyl acrylate, propyl acrylate, n-butyl acrylate, isobutyl acrylate, n-octyl acrylate, n-dodecyl acrylate, 2-ethylhexyl acrylate, stearyl acrylate, 2-chloroethyl acrylate, and phenyl acrylate.

Specific examples of usable methacrylic monomers include, but are not limited to, methacrylic acid and methacrylates. Specific examples of usable methacrylates include, but are not limited to, methyl methacrylate, ethyl methacrylate, propyl methacrylate, n-butyl methacrylate, isobutyl methacrylate, n-octyl methacrylate, n-dodecyl methacrylate, 2-ethylhexyl methacrylate, stearyl methacrylate, phenyl methacrylate, dimethylaminoethyl methacrylate, and diethylaminoethyl methacrylate.

Additionally, vinyl homopolymers or copolymers are also obtainable from the following monomers (1) to (18): (1) Monoolefins, such as ethylene, propylene, butylene, and isobutylene; (2) Polyenes, such as butadiene and isoprene; (3) Vinyl halides, such as vinyl chloride, vinylidene chloride, vinyl bromide, and vinyl fluoride; (4) Vinyl esters, such as vinyl acetate, vinyl propionate, and vinyl benzoate; (5) Vinyl ethers, such as vinyl methyl ether, vinyl ethyl ether, and vinyl isobutyl ether; (6) Vinyl ketones, such as vinyl methyl ketone, vinyl hexyl ketone, and methyl isopropenyl ketone; (7) N-Vinyl compounds, such as N-vinyl pyrrole, N-vinyl carbazole, N-vinyl indole, and N-vinyl pyrrolidone; (8) Vinylnaphthalenes; (9) Acrylic acid and methacrylic acid derivatives, such as acrylonitrile, methacrylonitrile, and acrylamide; (10) Unsaturated dibasic acids, such as maleic acid, citraconic acid, itaconic acid, alkenyl succinic acid, fumaric acid, and mesaconic acid; (11) Unsaturated dibasic acid anhydrides, such as maleic acid anhydride, citraconic acid anhydride, itaconic acid anhydride, and alkenyl succinic acid anhydride; (12) Monoesters of unsaturated dibasic acids, such as maleic acid monomethyl ester, maleic acid monoethyl ester, maleic acid monobutyl ester, citraconic acid monomethyl ester, citraconic acid monoethyl ester, citraconic acid monobutyl ester, itaconic acid monomethyl ester, alkenyl succinic acid monomethyl ester, fumaric acid monomethyl ester, and mesaconic acid monomethyl ester; (13) Unsaturated dibasic acid esters, such as dimethyl maleic acid and dimethyl fumaric acid; (14) α,β-Unsaturated acids, such as crotonic acid and cinnamic acid; (15) α,β-Unsaturated acid anhydrides, such as crotonic acid anhydride and cinnamic acid anhydride; (16) Carboxyl-group-containing monomers, such as anhydrides between α,β-unsaturated acids and lower fatty acids; and alkenyl malonic acid, alkenyl glutaric acid, alkenyl adipic acid, and anhydrides and monoesters thereof; (17) Hydroxyalkyl esters of acrylic acids and methacrylic acids, such as 2-hydroxyethyl acrylate, 2-hydroxyethyl methacrylate, and 2-hydroxypropyl methacrylate; and (18) Hydroxyl-group-containing monomers, such as 4-(1-hydroxy-1-methybutyl) styrene and 4-(1-hydroxy-1-methyhexyl)styrene.

The vinyl homopolymers and copolymers may include a cross-linking structure formed from a cross-linking agent having 2 or more vinyl groups.

Specific materials usable as the cross-linking agent include, but are not limited to, aromatic divinyl compounds, such as divinylbenzene and divinylnaphthalene; diacrylate compounds in which acrylates are bonded with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate; dimethacrylate compounds in which methacrylates are bonded with an alkyl chain, such as ethylene glycol dimethacrylate, 1,3-butylene glycol dimethacrylate, 1,4-butanediol dimethacrylate, 1,5-pentanediol dimethacrylate, 1,6-hexanediol dimethacrylate, and neopentyl glycol dimethacrylate; diacrylate compounds in which acrylates are bonded with an alkyl group having an ether bond, such as diethylene glycol diacrylate, triethylene glycol diacrylate, tetraethylene glycol diacrylate, polyethylene glycol #400 diacrylate, polyethylene glycol #600 diacrylate, and dipropylene glycol diacrylate; and dimethacrylate compounds in which methacrylates are bonded with an alkyl group having an ether bond, such as diethylene glycol dimethacrylate, triethylene glycol dimethacrylate, tetraethylene glycol dimethacrylate, polyethylene glycol #400 dimethacrylate, polyethylene glycol #600 dimethacrylate, and dipropylene glycol dimethacrylate.

Diacrylate and dimethacrylate compounds in which acrylates and methacrylates, respectively, are bonded with a chain having an aromatic group and an ether bond are also usable. A commercially-available polyester-based diacrylate MANDA (from Nippon Kayaku Co., Ltd.) is also usable as the cross-linking agent.

Additionally, polyfunctional cross-linking agents are also usable, such as pentaerythritol triacrylate, trimethylolethane triacrylate, trimethylolpropane triacrylate, tetramethylolmethane tetraacrylate, oligo ester acrylate, pentaerythritol trimethacrylate, trimethylolethane trimethacrylate, trimethylolpropane trimethacrylate, tetramethylolmethane tetramethacrylate, oligo ester methacrylate, triallyl cyanurate, and triallyl trimellitate.

In some embodiments, the amount of the cross-linking agent is 0.01 to 10 parts by weight or 0.03 to 5 parts by weight, based on 100 parts by weight of the monomer.

In some embodiments, an aromatic divinyl compound (divinylbenzene) or a diacrylate compound in which acrylates are bonded with a chain having an aromatic group and an ether bond is used. In some embodiments, a styrene copolymer and a styrene-acrylic copolymer are used in combination.

Specific examples of usable polymerization initiators in preparing the vinyl polymers or homopolymers include, but are not limited to, 2,2'-azobis isobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobis isobutyrate, 1,1'-azobis(1-cyclohexanecarbonitrile), 2-(carbamoylazo)-isobutyronitrile, 2,2'-azobis(2,4,4-trimethylpentane), 2-phenylazo-2',4'-dimethyl-4'-methoxyvaleronitrile, 2,2'-azobis(2-methylpropane), ketone peroxides (e.g., methyl ethyl ketone peroxide, acetyl acetone peroxide, cyclohexanone peroxide), 2,2-bis(tert-butylperoxy)butane, tert-butyl hydroperoxide, cumene hydroperoxide, 1,1,3,3-tetramethylbutyl hydroperoxide, di-tert-butyl peroxide, tert-butylcumyl peroxide, dicumyl peroxide, α-(tert-butylperoxy)isopropylbenzene, isobutyl peroxide, octanoyl peroxide, decanoyl peroxide, lauroyl peroxide, 3,5,5-trimethylhexanoyl peroxide, benzoyl peroxide, m-tolyl peroxide, di-isopropyl peroxydicarbonate, di-2-ethylhexyl peroxydicarbonate, di-n-propyl peroxydicarbonate, di-2-ethoxyethyl peroxycarbonate, di-ethoxyisopropyl peroxydicarbonate, di(3-methyl-3-methoxybutyl)peroxycarbonate, acetylcyclohexylsulfonyl peroxide, tert-butyl peroxyacetate, tert-butyl peroxyisobutyrate, tert-butyl peroxy-2-ethyl hexalate, tert-butyl peroxylaurate, tert-butyl-oxybenzoate, tert-butyl peroxyisopropyl carbonate, di-tert-butyl peroxyisophthalate, tert-butyl peroxyallyl carbonate, isoamyl peroxy-2-ethyl hexanoate, di-tert-butyl peroxyhexahydroterephthalate, and tert-butyl peroxyazelate.

In some embodiments, the binder resin includes a styrene-acrylic resin whose THF-soluble components has a molecular weight distribution such that at least one peak exists within a number average molecular weight range between 3,000 and 50,000 and at least one peak exists at a number average molecular weight range of 100,000 or more when measured by GPC (gel permeation chromatography). Such a binder resin provides a good combination of fixability, offset resistance, and storage stability.

In some embodiments, the binder resin includes 50 to 90% of THF-soluble components having a molecular weight of 100,000 or less. In some embodiments, the binder resin has a molecular weight distribution such that a maximum peak exists within a molecular weight range between 5,000 and 30,000 or between 5,000 and 20,000.

In some embodiments, the binder resin includes a vinyl polymer (e.g., a styrene-acrylic resin) having an acid value of 0.1 to 100 mgKOH/g, 0.1 to 70 mgKOH/g, or 0.1 to 50 mgKOH/g.

Usable polyester polymer may be formed from an alcohol and a carboxylic acid.

Specific examples of usable divalent alcohols include, but are not limited to, ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and diols obtained from a reaction between a cyclic ether (e.g., ethylene oxide, propylene oxide) and bisphenol A.

Tri- or more valent alcohols may be used in combination so that the resulting polyester polymer has cross-links. Specific examples of such tri- or more valent alcohols include, but are not limited to, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Specific examples of usable acids include, but are not limited to, benzene dicarboxylic acids (e.g., phthalic acid, isophthalic acid, terephthalic acid) and anhydrides thereof, alkyl dicarboxylic acids (e.g., succinic acid, adipic acid, sebacic acid, azelaic acid) and anhydrides thereof, unsaturated dibasic acids (e.g., maleic acid, citraconic acid, itaconic acid, alkenylsuccinic acid, fumaric acid, mesaconic acid), and unsaturated dibasic acid anhydrides (e.g., maleic acid anhydride, citraconic acid anhydride, itaconic acid anhydride, alkenylsuccinic acid anhydride).

Additionally, tri- or more valent carboxylic acids such as trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, enpol trimmer acid, and anhydrides and partial lower alkyl esters of these compounds, are also usable.

In some embodiments, the binder resin includes a polyester polymer having an acid value of 0.1 to 100 mgKOH/g, 0.1 to 70 mgKOH/g, or 0.1 to 50 mgKOH/g.

Molecular weight distribution of the binder resin can be measured by gel permeation chromatography (GPC) using THF as a solvent.

In some embodiments, the binder resin is a mixture of two or more of the above polymers, including a polymer having an acid value of 0.1 to 50 mgKOH/g in an amount of 60% by weight or more.

Acid value of the binder resin can be measured based on a method according to JIS K-0070 as follows.

(1) Remove materials other than the binder resin from a sample in advance. Alternatively, measure acid values and contents of the materials in the sample in advance. Thereafter, precisely weigh 0.5 to 2.0 g of the pulverized sample. For example, when the sample is a toner, measure acid values and contents of colorant, magnetic material, etc., included in the toner in advance.

(2) Dissolve the weighed sample in 150 ml of a mixed solvent of toluene/ethanol (4/1 by volume) in a 300-ml beaker.

(3) Subject the resulting liquid to a potentiometric titration using a 0.1 mol/l ethanol solution of KOH.

(4) Determine acid value of the binder resin from the following formula:

$$\text{Acid Value(mgKOH/g)}=[(S-B)\times f\times 5.61]/W$$

wherein W (g) represents the weight of the sample, S (ml) represents the used amount of the ethanol solution of KOH in the titration, B (ml) represents the used amount of the ethanol solution of KOH in a blank titration, and f represents the factor of KOH.

In some embodiments, the binder resin has a glass transition temperature (Tg) of 35 to 80° C. or 40 to 70° C., in view of storage stability of toner. When Tg is less than 35° C., the toner may easily deteriorate in high-temperature atmosphere. When Tg is greater than 80° C., the toner may have poor fixability.

Specific examples of usable colorants include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. Two or more of these colorants can be used in combination.

In some embodiments, the content of the colorant in the toner is 1 to 15% by weight or 3 to 10% by weight.

The colorant can be combined with a resin to be used as a master batch. Specific examples of usable resin for the master batch include, but are not limited to, polyester resins, polymers of styrene or styrene derivatives (e.g., polystyrene, poly-p-chlorostyrene, polyvinyl toluene), styrene-based copolymers (e.g., styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer), polymethyl methacrylate, polybutyl methacrylate, polyvinyl chloride, polyvinyl acetate, polyethylene, polypropylene, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. Two or more of these resins can be used in combination.

The master batch can be obtained by mixing and kneading a resin and a colorant while applying a high shearing force. To increase the interaction between the colorant and the resin, an organic solvent can be used. More specifically, the maser batch can be obtained by a method called flushing in which an aqueous paste of the colorant is mixed and kneaded with the resin and the organic solvent so that the colorant is transferred to the resin side, followed by removal of the organic solvent and moisture. This method is advantageous in that the resulting wet cake of the colorant can be used as it is without being dried. When performing the mixing or kneading, a high shearing force dispersing device such as a three roll mill can be used.

In some embodiments, the content of the master batch is 0.1 to 20 parts by weight based on 100 parts by weight of the binder resin.

In some embodiments, the resin for the master batch has an acid value of 30 mgKOH/g or less and an amine value of 1 to 100. In other embodiments, the resin for the master batch has an acid value of 20 mgKOH/g or less and an amine value of 10 to 50. When the acid value is greater than 30 mgKOH/g, chargeability and colorant dispersibility may be poor under high-humidity conditions. When the amine value is less than 1 or greater than 100, colorant dispersibility may be poor. Acid value can be measured based on a method according to JIS K0070. Amine value can be measured based on a method according to JIS K7237.

The colorant can be dispersed in a colorant dispersant to be used as a colorant dispersion. Commercially available colorant dispersants such as AJISPER PB821 and PB822 (from Ajinomoto Fine-Techno Co., Inc.), DISPERBYK-2001 (from BYK-Chemie GmbH), and EFKA-4010 (from EFKA) are usable because they have high affinity for the binder resin.

In some embodiments, the colorant dispersant has a weight average molecular weight of 500 to 100,000, 3,000 to 100,000, 5,000 to 50,000, or 5,000 to 30,000, which is determined from the maximum peak of styrene-conversion molecular weight observed in a gel permeation chromatogram. When the molecular weight is less than 500, polarity of the dispersant is so high that colorants cannot be finely dispersed. When the molecular weight is greater than 100,000, affinity of the dispersant for solvents is so high that colorants cannot be finely dispersed.

In some embodiments, the content of the colorant dispersant is 1 to 200 parts by weight or 5 to 80 parts by weight based on 100 parts by weight of the colorant. When the content is less than 1 part, colorant dispersibility may be poor. When the content is greater than 200 parts, chargeability may be poor.

Specific examples of usable release agents include, but are not limited to, aliphatic hydrocarbon waxes (e.g., low-molecular-weight polyethylene, low-molecular-weight polypropylene, polyolefin wax, microcrystalline wax, paraffin wax, SASOL wax), aliphatic hydrocarbon wax oxides (e.g., oxidized polyethylene wax) and block copolymers thereof, plant waxes (e.g., candelilla wax, carnauba wax, sumac wax, jojoba wax), animal waxes (e.g., bees wax, lanolin, spermaceti), mineral waxes (e.g., ozokerite, ceresin, petrolatum), waxes mainly composed of fatty acid esters (e.g., montanate wax, castor wax), and partially or completely deoxidized fatty acid esters (e.g., deoxidized carnauba wax).

Specific examples of usable release agents further include, but are not limited to, saturated straight-chain fatty acids (e.g., palmitic acid, stearic acid, montanic acid, straight-chain alkylcarboxylic acids), unsaturated fatty acids (e.g., brassidic acid, eleostearic acid, parinaric acid), saturated alcohols (e.g., stearyl alcohol, eicosyl alcohol, behenyl alcohol, carnaubyl alcohol, ceryl alcohol, melissyl alcohol, long-chain alkyl alcohol), polyols (e.g., sorbitol), fatty acid amides (e.g., linoleic acid amide, olefin acid amide, lauric acid amide), saturated fatty acid bisamides (e.g., methylenebis capric acid amide, ethylenebis lauric acid amide, hexamethylenebis stearic acid amide), unsaturated fatty acid amides (e.g., ethylenebis oleic acid amide, hexamethylenebis oleic acid amide, N,N'-dioleyl adipic acid amide, N,N'-dioleyl sebacic acid amide), aromatic biamides (e.g., m-xylenebis stearic acid amide, N,N-distearyl isophthalic acid amide), metal salts of fatty acids (e.g., calcium stearate, calcium laurate, zinc stearate, magnesium stearate), aliphatic hydrocarbon waxes to which a vinyl monomer such as styrene and an acrylic acid is grafted, partial ester compounds of a fatty acid with a polyol (e.g., behenic acid monoglyceride), and methyl ester compounds having a hydroxyl group obtained by hydrogenating plant fats.

Specific examples of usable release agents further include, but are not limited to, a polyolefin obtained by radical polymerizing an olefin under high pressure; a polyolefin obtained by purifying low-molecular-weight byproducts of a high-molecular-weight polyolefin; a polyolefin polymerized under low pressures in the presence of a Ziegler catalyst or a metallocene catalyst; a polyolefin polymerized using radiation, electromagnetic wave, or light; a low-molecular-weight polyolefin obtained by thermally decomposing a high-molecular-weight polyolefin; paraffin wax; microcrystalline wax; Fischer-Tropsch wax; synthetic hydrocarbon waxes synthesized by Synthol method, Hydrocaol method, or Arge method; synthetic waxes including a compound having one carbon atom as a monomer unit; hydrocarbon waxes having a functional group such as hydroxyl group and carboxyl group; mixtures of a hydrocarbon wax and a hydrocarbon wax having a functional group; and these waxes to which a vinyl monomer such as styrene, a maleate, an acrylate, a methacrylate, or a maleic anhydride is grafted.

The above release agents being further subjected to a press sweating method, a solvent method, a recrystallization method, a vacuum distillation method, a supercritical gas extraction method, or a solution crystallization method, so as to more narrow the molecular weight distribution thereof, are also usable. Further, the above release agents from which impurities such as low-molecular-weight solid fatty acids, low-molecular-weight solid alcohols, and low-molecular-weight solid compounds are removed are also usable.

In some embodiments, the amount of the release agent is 0.2 to 20 parts by weight or 0.5 to 10 parts by weight, based on 100 parts by weight of the binder resin.

In some embodiments, the release agent has a melting point of 70 to 140° C. or 70 to 120° C., in view of a good combination of fixability and offset resistance. When the melting point is less than 70° C., blocking resistance of the toner may be poor. When the melting point is greater than 140° C., hot offset resistance of the toner may be poor.

The melting point of release agent is defined as a temperature at which the maximum endothermic peak is observed in an endothermic curve of the release agent measured by differential scanning calorimetry (DSC). An endothermic curve can be obtained by a high-precision inner-heat power-compensation differential scanning calorimeter based on a method according to ASTM D3418-82. In some embodiments, an endothermic curve is obtained by heating a sample at a heating rate of 10° C./min after preliminarily heating and cooling the sample.

Usable organic solvents include, but are not limited to, ethers, ketones, esters, hydrocarbons, and alcohols. Specific examples of such solvents include, but are not limited to, tetrahydrofuran (THF), acetone, methyl ethyl ketone (MEK), ethyl acetate, and toluene. Two or more of these solvents can be used alone or in combination.

The toner constituents liquid is prepared by dissolving or dispersing toner constituents in an organic solvent. For the purpose of preventing the nozzles from being clogged with the toner constituents liquid, the toner constituents liquid may be prepared using a homomixer or bead mill so that dispersoids (i.e., toner constituents such as colorant and release agent) are finely dispersed.

In some embodiments, the toner constituents liquid has a solid content of 3 to 40% by weight. When the solid content is less than 3% by weight, the dispersoids are likely to settle out or aggregate, thereby reducing toner productivity and degrading toner quality. When the solid content is greater than 40% by weight, small-sized toner may not be obtained.

In some embodiments, the toner includes a fluidity improving agent. The fluidity improving agent is generally externally added to the surface of the toner to improve fluidity of the toner.

Specific materials usable as the fluidity improving agent include, but are not limited to, fine powders of silica prepared by a wet process or a dry process; fine powders of metal oxides such as titanium oxide and alumina; the above fine powders surface-treated with a silane-coupling agent, a titanium-coupling agent, or a silicone oil; and fine powders of fluorocarbon resins such as vinylidene fluoride and polytetrafluoroethylene. In some embodiments, fine powders of silica, titanium oxide, or alumina are used. In some embodiments, fine powders of silica which are surface-treated with a silane-coupling agent or a silicone oil are used.

In some embodiments, the fluidity improving agent has an average primary particle diameter of 0.001 to 2 μm or 0.002 to 0.2 μm.

Fine powders of silica may be obtained by gas phase oxidation of silicon halide, and they are generally called as fumed silica.

Specific examples of commercially available fine powders of such silica obtained by gas phase oxidation of silicon halides include, but are not limited to, AEROSIL-130, -300, -380, -TT600, -MOX170, -MOX80, and -COK84 (from Nippon Aerosil Co., Ltd.); CAB-O-SIL-M-5, -MS-7, -MS-75, -HS-5, and -EH-5 (from Cabot Corporation); WACKER HDK-N20V15, -N20E, -T30, and -T40 (from Wacker Chemie AG); D-C Fine Silica (from Dow Corning Corporation); and Fransol (from Fransil).

In some embodiments, fine powders of hydrophobized silica obtained by hydrophobizing silica prepared by gas phase oxidation of silicon halides are used. In some embodiments, the hydrophobized silica has a hydrophobicity degree of 30 to 80% when measured by a methanol titration test. Hydrophobicity is given by chemically or physically treating silica with an organic silicon compound which is reactive with or adsorptive to the silica. For example, fine powders of silica obtained from gas phase oxidation of silicon halides are treated with an organic silicon compound.

Specific examples of usable organic silicon compounds include, but are not limited to, hydroxypropyltrimethoxysilane, phenyltrimethoxysilane, n-hexadecyltrimethoxysilane, n-octadecyltrimethoxysilane, vinyltrimethoxysilane, vinyltriethoxysilane, vinyltriacetoxysilane, dimethylvinylchlorosilane, divinylchlorosilane, γ-methacryloxypropyltrimethoxysilane, hexamethyldisilazane, trimethylsilane, trimethylchlorosilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, trimethylethoxysilane, trimethylmethoxysilane, methyltriethoxysilane, isobutyltrimethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units and 0 to 1 terminal silanol group. Other than the above compounds, silicone oils such as dimethyl silicone oil are also usable. Two or more of these compounds can be used alone or in combination.

In some embodiments, the fluidity improving agent has a number average particle diameter of 5 to 100 nm or 5 to 50 nm.

In some embodiments, the fluidity improving agent has a specific surface area of 30 $m^2/g$ or more or 60 to 400 $m^2/g$ measured by the BET method employing nitrogen adsorption. In some embodiments, the surface-treated fluidity improving agent has a specific surface area of 20 $m^2/g$ or more or 40 to 300 $m^2/g$ measured by the BET method employing nitrogen adsorption.

In some embodiments, the content of the fluidity improving agent in the toner is 0.03 to 8 parts by weight based on 100 parts by weight of the toner.

The toner may further include other additives, such as metal soaps, fluorine-based surfactants, dioctyl phthalate, conductivity imparting agents (e.g., tin oxide, zinc oxide, carbon black, antimony oxide), and fine powders of inorganic materials (e.g., titanium oxide, aluminum oxide, alumina), for the purpose of protecting electrostatic latent image bearing members and carriers, improving cleanability and fixability, controlling thermal, electric, and physical properties, and controlling electric resistance and melting point. The fine powders of inorganic materials may be optionally hydrophobized.

The toner may further include other additives, such as lubricants (e.g., polytetrafluoroethylene, zinc stearate, polyvinylidene fluoride), abrasives (e.g., cesium oxide, silicon carbide, strontium titanate), anti-caking agents, and developability improving agents such as white or black particles having the opposite polarity to the toner particles.

For the purpose of controlling charge amount, the above-described additives may be treated with a silicone varnish, a modified silicone varnish, a silicone oil, a modified silicone oil, a silane-coupling agent, a silane-coupling agent having a functional group, or an organic silicon compound.

When preparing a developer, fine particles of inorganic materials (hereinafter "external additives") such as hydrophobized silica may be mixed with the toner to improve fluidity, storage stability, developability, and transferability of the developer. The toner may be mixed with such external additives by a mixer equipped with a jacket so that the inner temperature is variable. Load history given to the external additive may be varied when the external additive is gradually added or added from the middle of the mixing. Alternatively, it can be varied by varying the revolution, rotating speed, time, and temperature in the mixing. The load may be initially strong and may gradually weaken, or vice versa. Specific examples of usable mixers include, but are not limited to, a V-type mixer, a Rocking mixer, a Loedige mixer, a Nauta mixer, and a Henschel mixer.

Specific examples of usable inorganic materials include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. In some embodiments, fine particles of the inorganic material have a primary particle diameter of 5 nm to 2 μm or 5 nm to 500 nm.

In some embodiments, fine particles of the inorganic material have a BET specific surface area of 20 to 500 $m^2/g$. In some embodiments, the content of fine particles of the inorganic materials in the toner is 0.01 to 5% by weight or 0.01 to 2.0% by weight.

Additionally, fine particles of polymers prepared by soap-free emulsion polymerization, suspension polymerization, or dispersion polymerization (e.g., polystyrene, copolymers of methacrylates or acrylates), polycondensation polymers (e.g., silicone, benzoguanamine, nylon), and thermosetting resins are also usable as the external additive.

The surface of the external additive may be hydrophobized so as to prevent deterioration even under high-humidity conditions. Specific examples of usable surface treatment agents include, but are not limited to, silane coupling agents, silylation agents, silane coupling agents having a fluorinated alkyl group, organic titanate coupling agents, aluminum coupling agents, silicone oils, and modified silicone oils.

The toner may further include a cleanability improving agent so as to be easily removable from an electrostatic latent image bearing member or a primary transfer medium when remaining thereon after image transfer. Specific materials usable as the cleanability improving agent include, but are not limited to, metal salts of fatty acids (e.g., zinc stearate, calcium stearate) and fine particles of polymers prepared by soap-free emulsion polymerization (e.g., polymethyl methacrylate, polystyrene). In some embodiments, fine particles of polymers have a relatively narrow size distribution and a volume average particle diameter of 0.01 to 1 μm.

The toner may be mixed with a carrier to be used as a two-component developer.

The carrier may comprise, for example, a ferrite, a magnetite, or a resin-coated carrier. The resin-coated carrier is comprised of core particles covered with a resin coating layer. Specific examples of usable resins for the resin coating layer include, but are not limited to, styrene-acrylic resins (e.g., styrene-acrylate copolymer, styrene-methacrylate copolymer), acrylic resins (e.g., acrylate copolymer, methacrylate copolymer), fluorine-containing resins (e.g., polytetrafluoroethylene, monochlorotrifluoroethylene polymer, polyvinylidene fluoride), silicone resins, polyester resins, polyamide resins, polyvinyl butyral resins, and aminoacrylate resins. Further, ionomer resins and polyphenylene sulfide resins are also usable. Two or more of these resins can be used in combination.

Alternatively, the carrier may be also comprised of resin particles in which magnetic powder is dispersed. The resin-coated carrier may be obtained by applying a solvent solution or suspension of a resin (i.e., a coating liquid) to core particles or mixing a resin and core particles in a dry condition. In some embodiments, the content of the coating resin in the carrier is 0.01 to 5% by weight or 0.1 to 1% by weight based on 100 parts of the resin-coated carrier.

Core particles can be coated with a mixture of two or more resins. For example, 100 parts by weight of titanium oxide particles coated with 12 parts by weight of a mixture of dimethyldichlorosilane and dimethyl silicone oil (mixing ratio=1:5) can be used. As another example, 100 parts by weight of silica particles coated with 20 parts by weight of a mixture of dimethyldichlorosilane and dimethyl silicone oil (mixing ratio=1:5) can be used. In some embodiments, styrene-methyl methacrylate copolymer, a mixture of a fluorine-containing resin and a styrene copolymer, or a silicone resin is used as the coating resin.

The mixture of a fluorine-containing resin and a styrene copolymer may be, for example, a mixture of polyvinylidene fluoride and styrene-methyl methacrylate copolymer; a mixture of polytetrafluoroethylene and styrene-methyl methacrylate copolymer; or a mixture of a vinylidene fluoride-tetrafluoroethylene copolymer (copolymerization ratio is 10:90 to 90:10), a styrene-2-ethylhexyl acrylate copolymer (copolymerization ratio is 10:90 to 90:10), and a styrene-2-ethylhexyl acrylate-methyl methacrylate copolymer (copolymerization ratio is (20 to 60):(5 to 30):(10 to 50)). The silicone resin may be, for example, a nitrogen-containing silicon resin or a modified silicone resin obtained by reacting a nitrogen-containing silane-coupling agent with a silicone resin.

Specific materials usable as the core particles include, but are not limited to, oxides (e.g., ferrite, iron-excess ferrite, magnetite, γ-iron oxide), metals (e.g., iron, cobalt, nickel) and alloys thereof. The core particles may include an element such as iron, cobalt, nickel, aluminum, copper, lead, magnesium, tin, zinc, antimony, beryllium, bismuth, calcium, manganese, selenium, titanium, tungsten, and vanadium. In some embodiments, copper-zinc-iron ferrite or manganese-magnesium-iron ferrite is used.

In some embodiments, the carrier has a resistivity of $10^6$ to $10^{10}$ Ω·cm. Resistivity of the carrier depends on roughness of its surface or content of the coating resin. In some embodiments, the carrier has a particle diameter of 4 to 200 μm, 10 to 150 μm, or 20 to 100 μm. In some embodiments, the carrier has a 50% particle diameter of 20 to 70 μm. In some embodiments, the two-component developer includes the toner in an amount of 1 to 200 parts or 2 to 50 parts by weight based on 100 parts by weight of the carrier.

The toner may be used for electrophotography using typical electrostatic latent image bearing members such as organic electrostatic latent image bearing members, amorphous silica electrostatic latent image bearing members, selenium electrostatic latent image bearing members, and zinc oxide electrostatic latent image bearing members.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Colorant Dispersion

A carbon black (REGAL 400 from Cabot Corporation) in an amount of 17 parts and a colorant dispersant (AJISPER PB821 from Ajinomoto Fine-Techno Co., Inc.) in an amount of 3 parts were primarily dispersed in 80 parts of ethyl acetate using a mixer equipped with agitation blades. The resulting primary dispersion was further subjected to a dispersion treatment using a DYNOMILL so that the colorant was further pulverized by strong shearing force and aggregates having a size of 5 μm or more are completely removed.

Preparation of Wax Dispersion

In a vessel equipped with agitation blades and a thermometer, 18 parts of a carnauba wax and 2 parts of a wax dispersant are primarily dispersed in 80 parts of ethyl acetate. The resulting primary dispersion was heated to 80° C. while being agitated so that the carnauba wax was dissolved therein. Subsequently, the primary dispersion was cooled to room temperature so that particles of the carnauba wax settled out with a maximum particle diameter of 3 μm or less. As the wax dispersant, a dispersion of a polyethylene wax to which a styrene-butyl acrylate copolymer was grafted (hereinafter "graft polymer dispersion"), to be described in detail later, was used. The graft polymer dispersion was further subjected to a dispersion treatment using a bead mill (LMZ60 from Ashizawa Finetech Ltd.) so that the graft polymer particles were further pulverized into particles with a maximum particle diameter of 1 μm or less.

Preparation of Graft Polymer Dispersion

In an autoclave equipped with a thermometer and a stirrer, 100 parts of a low-molecular-weight polyethylene (SANWAX LEL-400 from Sanyo Chemical Industries, Ltd., having a softening point of 128° C.) were dissolved in 480 parts of xylene. After replacing the air in the autoclave with nitrogen gas, a mixture liquid of 755 parts of styrene, 100 parts of acrylonitrile, 45 parts of butyl acrylate 21 parts of acrylic acid, 36 parts of di-t-butyl peroxyhexahydroterephthalate, and 100 parts of xylene was dropped in the autoclave at 170° C. over a period of 3 hours so as to initiate a polymerization. The autoclave was kept heated at 170° C. for additional 0.5 hours. Thereafter, the organic solvents were removed from the resulting liquid. Thus, a graft polymer dispersion was prepared. The graft polymer had a number average molecular weight of 3,300, a weight average molecular weight of 18,000, a glass transition temperature of 65.0° C., and an SP value of 11.0 $(cal/cm^3)^{1/2}$.

Preparation of Toner Constituents Liquid

A toner constituents liquid was prepared by uniformly mixing 100 parts of an ethyl acetate solution of a polyester resin (having a weight average molecular weight of 32,000) having a solid content of 30.0%, 30 parts of the colorant dispersion, 30 parts of the wax dispersion, and 840 parts of ethyl acetate for 10 minutes using a mixer equipped with agitation blades. Either colorant or wax particles did not aggregate even when diluted with a solvent.

Preparation of Toner

Figure 12:
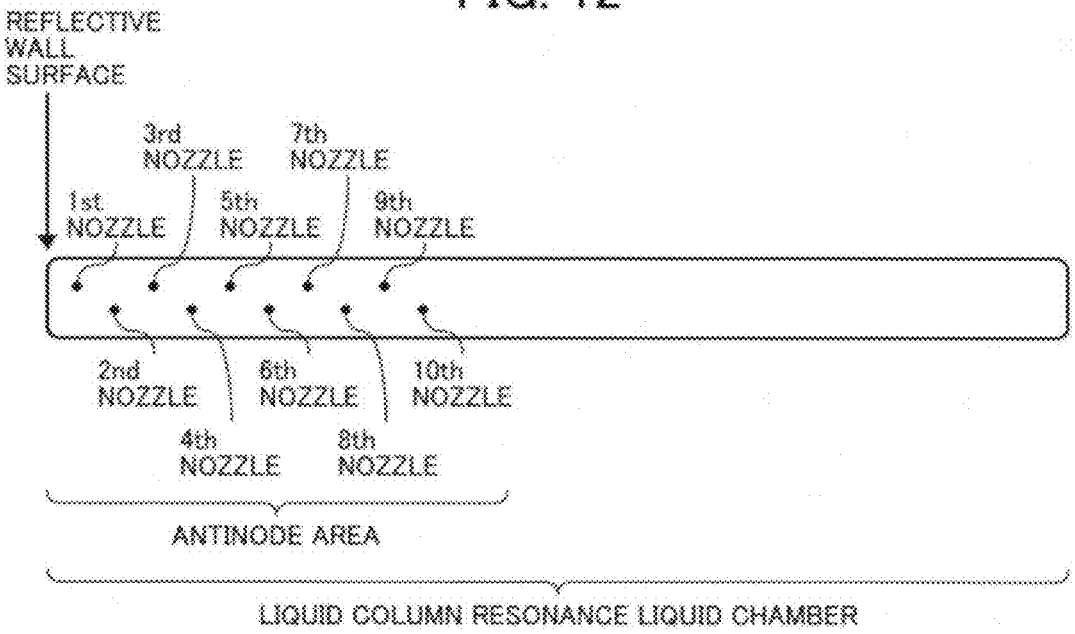
FIG. 12 is a view of nozzle arrangement according to an embodiment.

The toner constituents liquid thus prepared was set to the toner manufacturing apparatus 1 illustrated in FIG. 2 having the liquid droplet discharge head 11 illustrated in FIG. 3 having a nozzle arrangement illustrated in FIG. 12. The toner constituents liquid was formed into liquid droplets and the liquid droplets were dried and solidified into toner particles under the following conditions.

The vibration generator 20, adapted to apply vibration to the toner constituents liquid in the liquid column resonance liquid chamber 18, included in the liquid droplet discharge head 11 illustrated in FIG. 3 employed a piezoelectric element. The longitudinal length L of the liquid column resonance liquid chamber 18 was 1.85 mm and the vibration generator 20 applied a vibration having a frequency of 410 kHz to the toner constituents liquid in the liquid column resonance liquid chamber 18. As a result, a liquid column resonance pressure standing wave with a resonant mode N of 2 was formed. An area including an antinode of the pressure standing wave was extending from an end of the liquid column resonance liquid chamber 18 closer to the liquid common supply path 17 for a length of 0 to 0.46 mm, i.e., ±⅓ the wavelength.

FIG. 12 is a view of nozzle arrangement in this embodiment. Referring to FIG. 12, the first to tenth nozzles were disposed within an area including an antinode of the pressure standing wave. The first to tenth nozzles had an outlet diameter of 8.4 μm, 8.3 μm, 8.2 μm, 8.1 μm, 8.0 μm, 7.9 μm, 7.8 μm, 7.7 μm, 7.6 μm, and 7.5 μm, respectively. The interval between adjacent nozzles was 80 μm. The interval between adjacent even-numbered or odd-numbered nozzles was 135 μm.

An air current was generated in the airflow pathways 12 in the same direction as the direction of movement of liquid droplets. The discharged liquid droplets were dried and solidified into mother toner particles in the drying collecting unit 30. The mother toner particles were collected by a 1-μm cyclone and dried by a blower at 35° C. for 48 hours.

Toner Manufacturing Conditions

Specific weight of the toner constituents liquid: $\rho=1.2$ $g/cm^3$

Drive frequency: 410 kHz

Peak value of applied voltage sine wave: 11 V

Dry air temperature: 35° C.

The collected mother toner particles were subjected to a measurement of particle size distribution with a flow particle image analyzer (FPIA-2000 from Sysmex Corporation). As a result, the mother toner particles had a weight average particle diameter (D4) of 5.5 μm and a number average particle diameter (Dn) of 5.2 μm. The particle size distribution (D4/Dn) was 1.06.

The measurement procedure was as follows. First, several drops of a nonionic surfactant (preferably CONTAMINON N from Wako Pure Chemical Industries, Ltd.) were added to 10 ml of water from which fine foreign substances had been previously removed by a filter and, as a result, containing particles having a circle-equivalent diameter which fall within the measuring range (e.g., not less than 0.60 μm and less than 159.21 μm) in a number only 20 or less per $10^{-3}$ $cm^3$. Subsequently, 5 mg of a sample (e.g., the mother toner particles) were added to the water and the resulting liquid was subjected to a dispersion treatment for 1 minute at 20 kHz and 50 W/10 $cm^3$ using an ultrasonic disperser UH-50 (from SMT Corporation). The liquid was further subjected to the dispersion treatment for 5 minutes in total. Thus, a sample dispersion was prepared containing 4,000 to 8,000 sample particles having a circle-equivalent diameter which fall within the measuring range of not less than 0.60 μm and less than 159.21 μm per $10^{-3}$ $cm^3$.

Next, the sample dispersion was passed through a flow path of a flat transparent flow cell having a thickness of about 200 μm. A stroboscopic lamp and a CCD camera were respectively provided on opposite sides of the flow cell so that an optical path was formed crossing the thickness direction of the flow cell. While the sample dispersion was flowing, the stroboscopic lamp was emitting light at an interval of 1/30 seconds to obtain a two-dimensional image of the particles flowing in the flow cell that was parallel to at least a part of the flow cell. Circle-equivalent diameter of each particle was calculated from the diameter of a circle having the same area as the two-dimensional image of the particle.

More than 1,200 particles were subjected to the measurement of circle-equivalent diameter in about 1 minute in the above procedure. Thus, a number distribution and a ratio (% by number) of particles having a specific circle-equivalent diameter were determined. In the resulting frequency and cumulative distributions (%), a range of 0.06 to 400 μm was divided into 226 channels (i.e., 1 octave was divided into 30 channels). The actual measuring range was not less than 0.60 μm and less than 159.21 μm.

External Treatment

The mother toner particles were mixed with 1.0% of a hydrophobized silica (H2000 from Clamant Japan K.K.) using a HENSCHEL MIXER (from Mitsui Mining Co., Ltd.). Thus, a toner was prepared.

Preparation of Carrier

A coating layer dispersion was prepared by dispersing 100 parts of a silicone resin (SR2406 from Dow Corning Toray Co., Ltd.) and a catalyst (U-200 from Nitto Kasei Kogyo K.K.) in 500 parts of toluene. The coating layer dispersion was spray-coated on a core material (i.e., spherical ferrite particles having a weight average particle diameter of 50 μm) while applying heat, followed by burning and cooling. Thus, a carrier having a coating layer having an average thickness of 0.2 μm was prepared.

Preparation of Developer

A two-component developer was prepared by mixing 4 parts of the toner and 96 parts of the carrier.

Comparative Example 1

The procedure in Example 1 was repeated except for replacing the toner manufacturing apparatus 1 with another toner manufacturing apparatus A. The toner manufacturing apparatus A had the same configuration as the toner manufacturing apparatus 1 except that the first to tenth nozzles had the same outlet diameter of 8.0 μm.

Evaluations

Figure 13:
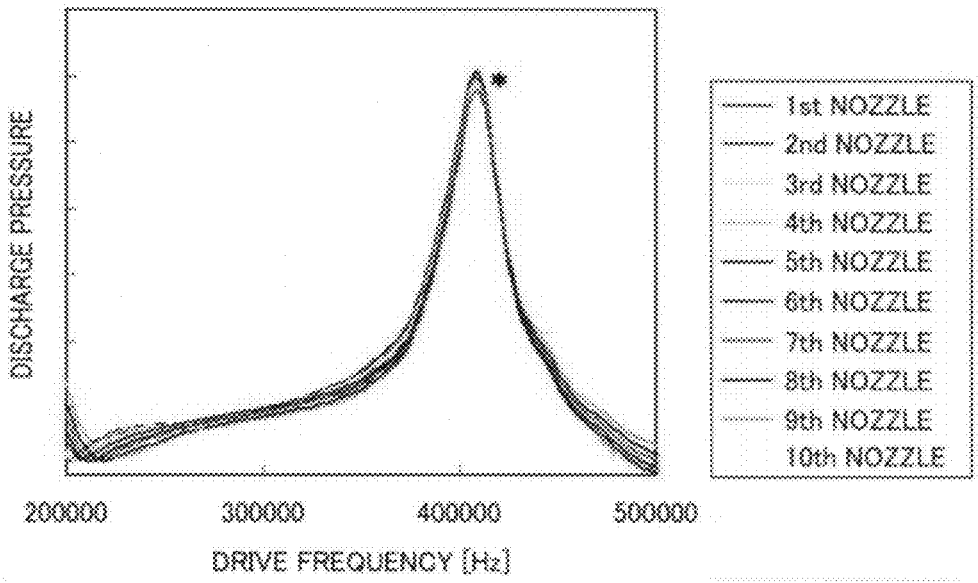
FIG. 13 is a graph showing frequency characteristic of discharge pressure at a vicinity of each nozzle in Example 1.
Figure 14:
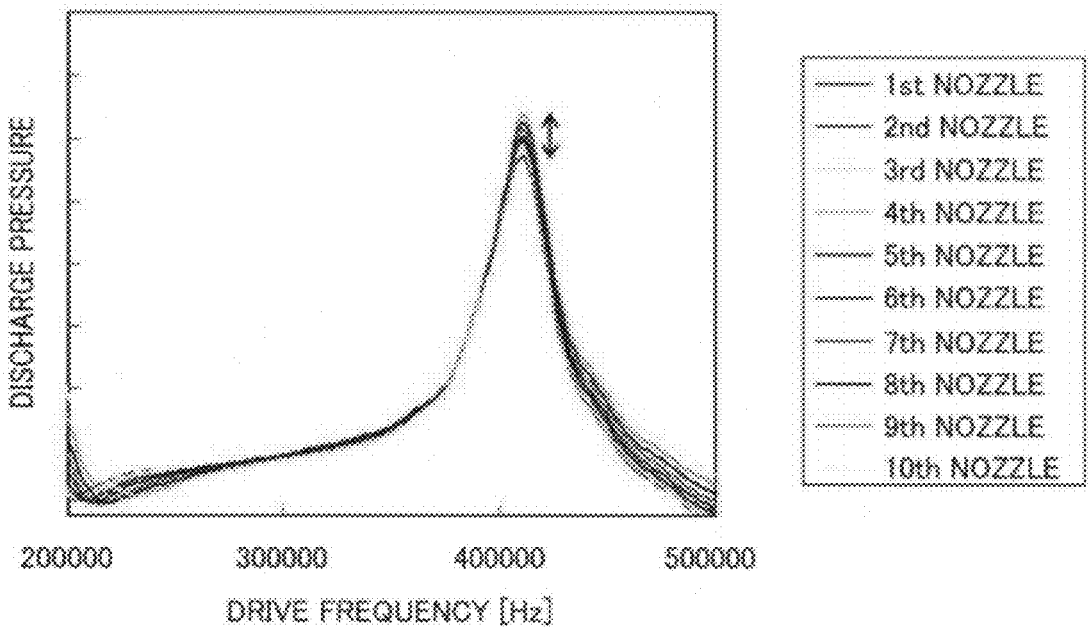
FIG. 14 is a graph showing frequency characteristic of discharge pressure at a vicinity of each nozzle in Comparative Example.

Measurement of Pressure Distribution within Liquid Column Resonance Liquid Chamber A pressure distribution in the liquid column resonance liquid chamber was determined by a fluid calculation using a finite difference method. The result in Example 1 is shown in FIG. 13. The result in Comparative Example 1 is shown in FIG. 14.

Additionally, a pressure applied to the toner constituents liquid within the liquid column resonance liquid chamber at a vicinity of each nozzle, i.e., a space extending from each nozzle for a distance of 10 μm, was also determined by the fluid calculation. As a result, it was confirmed that the discharged liquid droplets had certain volume and particle diameter distributions in accordance with the pressure distribution.

Figure 15:
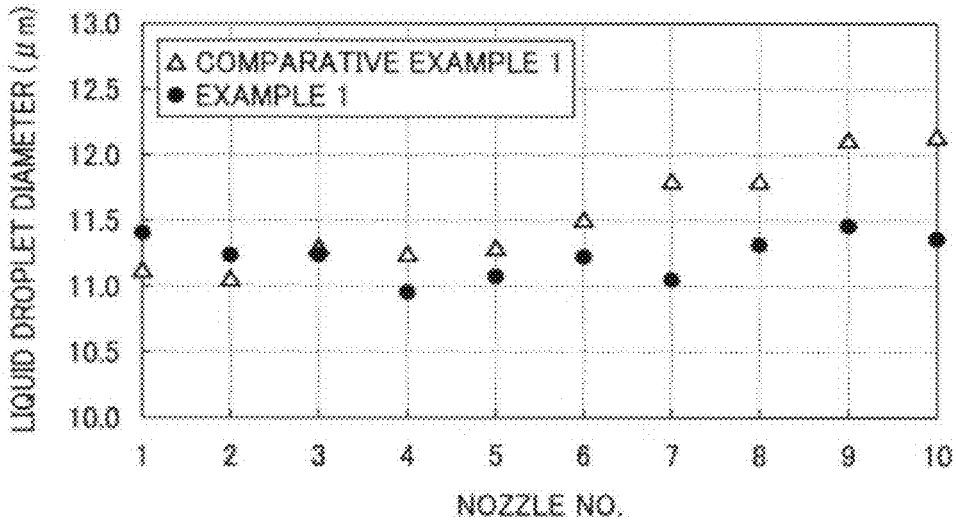
FIG. 15 is a graph showing liquid droplet diameter at each nozzle in Example 1 and Comparative Example 1.

Measurement of Particle Diameter and Particle Size Distribution of Liquid Droplets The liquid droplet discharge phenomenon was photographed by laser shadowgraphy in the same manner as FIG. 8. Circle-equivalent diameter of each liquid droplet was calculated from the diameter of a circle having the same area as the two-dimensional image of the liquid droplet. The results in Example 1 and Comparative Example 18 to be described later) are shown in FIG. 15.

Measurement of Particle Size Distribution of Mother Toner Particles

The mother toner particles were subjected to a measurement of particle size distribution with a flow particle image analyzer (FPIA-2000 from Sysmex Corporation). As a result, the mother toner particles had a weight average particle diameter (D4) of 5.5 μm and a number average particle diameter (Dn) of 5.2 μm. The particle size distribution (D4/Dn) was 1.06.

Evaluation of Thin Line Reproducibility

The above-prepared developer is set in a commercially-available copier (IMAGIO NEO 271 from Ricoh Co., Ltd.) and a running test is performed. In the running test, an image having an image occupancy of 7% is continuously printed on sheets of a paper TYPE 600 (from Ricoh Co., Ltd.). The 10th image (i.e., an initial image) and the 30,000th image are visually observed with an optical microscope at a magnification of 1,000,000 to evaluate thin line reproducibility with reference to a 4-point scale (A, B, C, and D). A is the best and D is the worst. The grade D is not commercially viable.

The evaluation results are shown in Table 1.

TABLE 1

| | Number of Nozzles | Outlet Diameter of Nozzles (μm) | Weight Average Particle Diameter (D4) (μm) | Number Average Particle Diameter (Dn) (μm) | D4/Dn | Thin Line Reproducibility |
|---|---|---|---|---|---|---|
| Comparative Example 1 | 10 | 8 | 5.6 | 5.1 | 1.1 | B |
| Example 1 | 10 | 8.4-7.5 | 5.5 | 5.2 | 1.06 | A |

In Comparative Example 1, as shown in FIG. 15, the difference between the minimum and maximum liquid droplet diameters is about 10%. FIG. 14 is a graph showing frequency characteristic of instantaneous maximum discharge pressure at a vicinity of each nozzle in Comparative Example 1 determined by a fluid calculation. As shown in FIG. 14, all the nozzles are most effective when the drive frequency is 410 kHz. Therefore, the liquid column resonant frequency is estimated at 410 kHz, which is also confirmed by an actual experiment. However, in Comparative Example 1, the instantaneous maximum discharge pressures are varied among the nozzles. In other words, a pressure distribution is formed among the nozzles. Thus, the discharged liquid droplets have certain volume and particle diameter distributions in accordance with the pressure distribution, as shown in FIG. 15.

In Example 1, the first to tenth nozzles have an outlet diameter of 8.4 μm, 8.3 μm, 8.2 μm, 8.1 μm, 8.0 μm, 7.9 μm, 7.8 μm, 7.7 μm, 7.6 μm, and 7.5 μm, respectively. On the other hand, in Comparative Example 1, the first to tenth nozzles have the same outlet diameter. FIG. 13 is a graph showing frequency characteristic of instantaneous maximum discharge pressure at a vicinity of each nozzle in Example 1 determined by a fluid calculation. As shown in FIG. 13, instantaneous maximum discharge pressures are almost same at all the nozzles at a drive frequency of 410 kHz. Thus, as shown in FIG. 15, the difference between the minimum and maximum liquid droplet diameters is about 0.5 μm in Example 1. When the pressure distribution is uniform regardless of outlet diameter and arrangement of the nozzles, uniform liquid droplets can be obtained.

Additional modifications and variations in accordance with further embodiments of the present invention are possible in light of the above teachings. It is therefore to be understood that within the scope of the appended claims the invention may be practiced other than as specifically described herein.

What is claimed is:

1. A method of manufacturing toner, comprising:

forming liquid droplets, including:

vibrating a toner constituents liquid in a liquid column resonance liquid chamber having a plurality of nozzles to form a liquid column resonance pressure standing wave therein; and discharging the toner constituents liquid from the nozzles; and solidifying the liquid droplets, wherein the toner constituents liquid includes an organic solvent and toner constituents dissolved or dispersed in the organic solvent, the toner constituents including a resin, a colorant, and a release agent, wherein the nozzles are disposed within an area including an antinode of the liquid column resonance pressure standing wave, and wherein one of the nozzles disposed closer to a node of the liquid column resonance pressure standing wave has a smaller outlet diameter than that disposed farther from the node, and the toner constituents liquid is applied with a uniform pressure at a vicinity of each nozzle.

2. The method according to claim 1, wherein one of the nozzles disposed closest to a liquid common supply path has the smallest outlet diameter.

3. The method according to claim 1, wherein the liquid column resonance liquid chamber has 2 to 20 nozzles.

4. The method according to claim 1, wherein the liquid column resonance liquid chamber includes a reflective wall surface on at least one longitudinal end.

5. The method according to claim 1, wherein the following equation (1) is satisfied:

$$f=N\times c/(4L) \quad (1)$$

wherein f represents a vibration frequency in vibrating the toner constituents liquid, L represents a longitudinal length of the liquid column resonance liquid chamber, c represents a sonic speed in the toner constituents liquid, and N represents a natural number.

6. The method according to claim 1, wherein the following equation (2) is satisfied:

$$N\times c/(4L)\leq f\leq N\times c/(4Le) \quad (2)$$

wherein f represents a vibration frequency in vibrating the toner constituents liquid, L represents a longitudinal length of the liquid column resonance liquid chamber, Le represents a distance between an end of a liquid common supply path and the center of a nozzle closest to the end, c represents a sonic speed in the toner constituents liquid, and N represents a natural number.

7. The method according to claim 6, wherein the following inequality is satisfied:

$$Le/L>0.6.$$

8. The method according to claim 1, wherein the following equation (3) is satisfied:

$$N\times c/(4L)\leq f\leq (N+1)\times c/(4Le) \quad (3)$$

wherein f represents a vibration frequency in vibrating the toner constituents liquid, L represents a longitudinal length of the liquid column resonance liquid chamber, Le represents a distance between an end of a liquid common supply path and the center of a nozzle closest to the end, c represents a sonic speed in the toner constituents liquid, and N represents a natural number.

9. The method according to claim 8, wherein the following inequality is satisfied:

$$Le/L>0.6.$$

10. The method according to claim 1, wherein a vibration frequency in vibrating the toner constituents liquid is 300 kHz or more.

11. The method according to claim 1, wherein the solidifying the liquid droplets further includes:

conveying the liquid droplets by an air current.

12. The method according to claim 11, wherein the air current has a greater velocity than an initial discharge velocity of the liquid droplets.

13. A method of manufacturing resin particle, comprising:

forming liquid droplets, including:

vibrating a liquid in a liquid column resonance liquid chamber having a plurality of nozzles to form a liquid column resonance pressure standing wave therein; and discharging the liquid from the nozzles; and solidifying the liquid droplets, wherein the liquid is a melted resin or an organic solvent solution or dispersion of a resin, wherein the nozzles are disposed within an area including an antinode of the liquid column resonance pressure standing wave, and wherein one of the nozzles disposed closer to a node of the liquid column resonance pressure standing wave has a smaller outlet diameter than that disposed farther from the node, and the liquid is applied with a uniform pressure at a vicinity of each nozzle.

* * * * *